US009926766B2

(12) United States Patent
Xu et al.

(10) Patent No.: US 9,926,766 B2
(45) **Date of Patent: *Mar. 27, 2018**

(54) SEAT FOR A TUBULAR TREATING SYSTEM

(71) Applicants: YingQing Xu, Tomball, TX (US); Gregory Lee Hern, Porter, TX (US)

(72) Inventors: YingQing Xu, Tomball, TX (US); Gregory Lee Hern, Porter, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 382 days.

This patent is subject to a terminal disclaimer.

(21) Appl. No.: 14/645,847

(22) Filed: Mar. 12, 2015

(65) Prior Publication Data

US 2015/0184485 A1 Jul. 2, 2015

Related U.S. Application Data

(62) Division of application No. 13/358,317, filed on Jan. 25, 2012, now Pat. No. 9,010,416.

(51) Int. Cl.
*E21B 33/129* (2006.01)
*E21B 23/01* (2006.01)

(52) U.S. Cl.
CPC ..... *E21B 33/129* (2013.01); *E21B 23/01* (2013.01)

(58) Field of Classification Search
CPC ..... E21B 23/01; E21B 33/129
See application file for complete search history.

(56) References Cited

U.S. PATENT DOCUMENTS

| | | | |
|---|---|---|---|
| 1,468,905 | A | 9/1923 | Herman |
| 1,558,066 | A | 10/1925 | Veazey et al. |
| 1,880,614 | A | 10/1932 | Wetherill |
| 2,011,613 | A | 8/1935 | Brown et al. |
| 2,094,578 | A | 10/1937 | Blumenthal et al. |
| 2,189,697 | A | 2/1940 | Baker |
| 2,222,233 | A | 11/1940 | Mize |

(Continued)

FOREIGN PATENT DOCUMENTS

| | | | |
|---|---|---|---|
| CA | 2783241 | A1 | 6/2011 |
| CA | 2783346 | A1 | 6/2011 |

(Continued)

OTHER PUBLICATIONS

Chinese Office Action; Chinese Application No. 201280041320.0; dated May 11, 2015; pp. 1-17.

(Continued)

*Primary Examiner* — Robert E Fuller
(74) *Attorney, Agent, or Firm* — Cantor Colburn LLP

(57) ABSTRACT

A seat for a tubular treating system includes a single piece body having a central portion, and a frustoconical surface extending longitudinally from the central portion in a first direction configured to radially expand slips urged thereagainst. The seat also includes a collar extending longitudinally from the central portion in a second direction configured to be radially expanded into sealing engagement with a structure in response to a frustoconical member urged thereagainst. A seal surface is sealably engagable with a plug run thereagainst, and the seal surface is longitudinally displaced from the collar in the first direction.

6 Claims, 6 Drawing Sheets

(56) References Cited

U.S. PATENT DOCUMENTS 2,225,143 A 12/1940 Baker et al.
2,238,895 A 4/1941 Gage
2,261,292 A 11/1941 Salnikov
2,294,648 A 9/1942 Ansel
2,301,624 A 11/1942 Holt
2,352,993 A 7/1944 Albertson
2,394,843 A 2/1946 Cooke et al.
2,672,199 A 3/1954 McKenna
2,753,941 A 7/1956 Hebard et al.
2,754,910 A 7/1956 Derrick et al.
2,933,136 A 4/1960 Ayers et al.
2,983,634 A 5/1961 Budininkas et al.
3,057,405 A 10/1962 Mallinger
3,066,391 A 12/1962 Vordahl
3,106,959 A 10/1963 Huitt et al.
3,142,338 A 7/1964 Brown
3,152,009 A 10/1964 Delong
3,180,728 A 4/1965 Keir et al.
3,180,778 A 4/1965 Stilli et al.
3,196,949 A 7/1965 Thomas
3,226,314 A 12/1965 Wellington et al.
3,242,988 A 3/1966 McGuire et al.
3,295,935 A 1/1967 Pflumm et al.
3,316,748 A 5/1967 Lang et al.
3,326,291 A 6/1967 Zandmer et al.
3,343,537 A 9/1967 Graham
3,347,317 A 10/1967 Zandemer
3,347,714 A 10/1967 Broverman et al.
3,390,724 A 7/1968 Caldwell
3,395,758 A 8/1968 Kelly et al.
3,406,101 A 10/1968 Kilpatrick
3,416,918 A 12/1968 Henry
3,434,539 A 3/1969 Merritt
3,465,181 A 9/1969 Colby et al.
3,489,218 A 1/1970 Means
3,513,230 A 5/1970 Rhees et al.
3,600,163 A 8/1971 Badia et al.
3,602,305 A 8/1971 Kisling
3,637,446 A 1/1972 Elliott et al.
3,645,331 A 2/1972 Maurer et al.
3,660,049 A 5/1972 Benjamin
3,765,484 A 10/1973 Hamby, Jr. et al.
3,768,563 A 10/1973 Blount
3,775,823 A 12/1973 Adolph et al.
3,816,080 A 6/1974 Bomford et al.
3,823,045 A 7/1974 Hielema
3,878,889 A 4/1975 Seabourn
3,894,850 A 7/1975 Kovalchuk et al.
3,924,677 A 12/1975 Prenner et al.
3,957,483 A 5/1976 Suzuki
4,010,583 A 3/1977 Highberg
4,039,717 A 8/1977 Titus
4,050,529 A 9/1977 Tagirov et al.
4,157,732 A 6/1979 Fonner
4,248,307 A 2/1981 Silberman et al.
4,284,137 A 8/1981 Taylor
4,292,377 A 9/1981 Petersen et al.
4,372,384 A 2/1983 Kinney
4,373,584 A 2/1983 Silberman et al.
4,373,952 A 2/1983 Parent
4,374,543 A 2/1983 Richardson
4,384,616 A 5/1983 Dellinger
4,395,440 A 7/1983 Abe et al.
4,399,871 A 8/1983 Adkins et al.
4,407,368 A 10/1983 Erbstoesser
4,422,508 A 12/1983 Rutledge, Jr. et al.
4,450,136 A 5/1984 Dudek et al.
4,452,311 A 6/1984 Speegle et al.
4,475,729 A 10/1984 Costigan
4,498,543 A 2/1985 Pye et al.
4,499,048 A 2/1985 Hanejko
4,499,049 A 2/1985 Hanejko
4,524,825 A 6/1985 Fore
4,526,840 A 7/1985 Jerabek
4,534,414 A 8/1985 Pringle
4,539,175 A 9/1985 Lichti et al.
4,554,986 A 11/1985 Jones
4,619,699 A 10/1986 Petkovic-Luton et al.
4,640,354 A 2/1987 Boisson
4,648,901 A 3/1987 Murray et al.
4,664,962 A 5/1987 Desmarais, Jr.
4,668,470 A 5/1987 Gilman et al.
4,673,549 A 6/1987 Ecer
4,674,572 A 6/1987 Gallus
4,678,037 A 7/1987 Smith
4,681,133 A 7/1987 Weston
4,688,641 A 8/1987 Knieriemen
4,690,796 A 9/1987 Paliwal
4,693,863 A 9/1987 Del Corso et al.
4,703,807 A 11/1987 Weston
4,706,753 A 11/1987 Ohkochi et al.
4,708,202 A 11/1987 Sukup et al.
4,708,208 A 11/1987 Halbardier
4,709,761 A 12/1987 Setterberg, Jr.
4,714,116 A 12/1987 Brunner
4,716,964 A 1/1988 Erbstoesser et al.
4,719,971 A 1/1988 Owens
4,721,159 A 1/1988 Ohkochi et al.
4,738,599 A 4/1988 Shilling
4,741,973 A 5/1988 Condit et al.
4,768,588 A 9/1988 Kupsa
4,775,598 A 10/1988 Jaeckel
4,784,226 A 11/1988 Wyatt
4,805,699 A 2/1989 Halbardier
4,817,725 A 4/1989 Jenkins
4,834,184 A 5/1989 Streich et al.
H635000 6/1989 Johnson et al.
4,850,432 A 7/1989 Porter et al.
4,853,056 A 8/1989 Hoffman
4,869,324 A 9/1989 Holder
4,869,325 A 9/1989 Halbardier
4,880,059 A 11/1989 Brandell et al.
4,889,187 A 12/1989 Terrell et al.
4,890,675 A 1/1990 Dew
4,901,794 A 2/1990 Baugh et al.
4,909,320 A 3/1990 Hebert et al.
4,917,966 A 4/1990 Wilde et al.
4,921,664 A 5/1990 Couper
4,929,415 A 5/1990 Okazaki
4,932,474 A 6/1990 Schroeder, Jr. et al.
4,934,459 A * 6/1990 Baugh ..... E21B 23/01 166/380
4,938,309 A 7/1990 Emdy
4,938,809 A 7/1990 Das et al.
4,944,351 A 7/1990 Eriksen et al.
4,949,788 A 8/1990 Szarka et al.
4,952,902 A 8/1990 Kawaguchi et al.
4,975,412 A 12/1990 Okazaki et al.
4,977,958 A 12/1990 Miller
4,981,177 A 1/1991 Carmody et al.
4,986,361 A 1/1991 Mueller et al.
4,997,622 A 3/1991 Regazzoni et al.
5,006,044 A 4/1991 Walker, Sr. et al.
5,010,955 A 4/1991 Springer
5,036,921 A 8/1991 Pittard et al.
5,048,611 A 9/1991 Cochran
5,049,165 A 9/1991 Tselesin
5,061,323 A 10/1991 Deluccia
5,063,775 A 11/1991 Walker, Sr. et al.
5,073,207 A 12/1991 Faure et al.
5,074,361 A 12/1991 Brisco et al.
5,076,869 A 12/1991 Bourell et al.
5,084,088 A 1/1992 Okazaki
5,087,304 A 2/1992 Chang et al.
5,090,480 A 2/1992 Pittard et al.
5,095,988 A 3/1992 Bode
5,103,911 A 4/1992 Heijnen
5,117,915 A 6/1992 Mueller et al.
5,161,614 A 11/1992 Wu et al.
5,171,734 A 12/1992 Sanjurjo et al.
5,178,216 A 1/1993 Giroux et al.
5,181,571 A 1/1993 Mueller et al.
5,183,631 A 2/1993 Kugimiya et al.
5,188,182 A 2/1993 Echols, III et al.

(56) References Cited

U.S. PATENT DOCUMENTS 5,188,183 A 2/1993 Hopmann et al.
5,204,055 A 4/1993 Sachs et al.
5,222,867 A 6/1993 Walker, Sr. et al.
5,226,483 A 7/1993 Williamson, Jr.
5,228,518 A 7/1993 Wilson et al.
5,234,055 A 8/1993 Cornette
5,240,742 A 8/1993 Johnson et al.
5,252,365 A 10/1993 White
5,253,714 A 10/1993 Davis et al.
5,271,468 A 12/1993 Streich et al.
5,273,569 A 12/1993 Gilman et al.
5,282,509 A 2/1994 Schurr, III
5,285,798 A 2/1994 Banerjee et al.
5,292,478 A 3/1994 Scorey
5,293,940 A 3/1994 Hromas et al.
5,304,260 A 4/1994 Aikawa et al.
5,304,588 A 4/1994 Boysen et al.
5,309,874 A 5/1994 Willermet et al.
5,310,000 A 5/1994 Arterbury et al.
5,316,598 A 5/1994 Chang et al.
5,318,746 A 6/1994 Lashmore
5,352,522 A 10/1994 Kugimiya et al.
5,380,473 A 1/1995 Bogue et al.
5,387,380 A 2/1995 Cima et al.
5,392,860 A 2/1995 Ross
5,394,236 A 2/1995 Murnick
5,394,941 A 3/1995 Venditto et al.
5,398,754 A 3/1995 Dinhoble
5,407,011 A 4/1995 Layton
5,409,555 A 4/1995 Fujita et al.
5,411,082 A 5/1995 Kennedy
5,417,285 A 5/1995 Van Buskirk et al.
5,425,424 A 6/1995 Reinhardt et al.
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,456,317 A 10/1995 Hood, III et al.
5,456,327 A 10/1995 Denton et al.
5,464,062 A 11/1995 Blizzard, Jr.
5,472,048 A 12/1995 Kennedy et al.
5,474,131 A 12/1995 Jordan, Jr. et al.
5,477,923 A 12/1995 Jordan, Jr. et al.
5,479,986 A 1/1996 Gano et al.
5,494,538 A 2/1996 Kirillov et al.
5,506,055 A 4/1996 Dorfman et al.
5,507,439 A 4/1996 Story
5,511,620 A 4/1996 Baugh et al.
5,524,699 A 6/1996 Cook
5,526,880 A 6/1996 Jordan, Jr. et al.
5,526,881 A 6/1996 Martin et al.
5,529,746 A 6/1996 Knoss et al.
5,531,735 A 7/1996 Thompson
5,533,573 A 7/1996 Jordan, Jr. et al.
5,536,485 A 7/1996 Kume et al.
5,558,153 A 9/1996 Holcombe et al.
5,601,924 A 2/1997 Beane
5,607,017 A 3/1997 Owens et al.
5,623,993 A 4/1997 Van Buskirk et al.
5,623,994 A 4/1997 Robinson
5,636,691 A 6/1997 Hendrickson et al.
5,641,023 A 6/1997 Ross et al.
5,647,444 A 7/1997 Williams
5,665,289 A 9/1997 Chung et al.
5,677,372 A 10/1997 Yamamoto et al.
5,685,372 A 11/1997 Gano
5,701,576 A 12/1997 Fujita et al.
5,707,214 A 1/1998 Schmidt
5,709,269 A 1/1998 Head
5,720,344 A 2/1998 Newman
5,722,033 A 2/1998 Carden
5,728,195 A 3/1998 Eastman et al.
5,765,639 A 6/1998 Muth
5,772,735 A 6/1998 Sehgal et al.
5,782,305 A 7/1998 Hicks
5,797,454 A 8/1998 Hipp
5,820,608 A 10/1998 Luzio et al.
5,826,652 A 10/1998 Tapp
5,826,661 A 10/1998 Parker et al.
5,829,520 A 11/1998 Johnson
5,836,396 A 11/1998 Norman
5,857,521 A 1/1999 Ross et al.
5,881,816 A 3/1999 Wright
5,896,819 A 4/1999 Turila et al.
5,902,424 A 5/1999 Fujita et al.
5,934,372 A 8/1999 Muth
5,941,309 A 8/1999 Appleton
5,960,881 A 10/1999 Allamon et al.
5,964,965 A 10/1999 Schulz et al.
5,985,466 A 11/1999 Atarashi et al.
5,988,287 A 11/1999 Jordan, Jr. et al.
5,990,051 A 11/1999 Ischy et al.
5,992,452 A 11/1999 Nelson, II
5,992,520 A 11/1999 Schultz et al.
6,007,314 A 12/1999 Nelson, II
6,024,915 A 2/2000 Kume et al.
6,030,637 A 2/2000 Whitehead
6,032,735 A 3/2000 Echols
6,036,777 A 3/2000 Sachs
6,047,773 A 4/2000 Zeltmann et al.
6,050,340 A 4/2000 Scott
6,069,313 A 5/2000 Kay
6,076,600 A 6/2000 Vick, Jr. et al.
6,079,496 A 6/2000 Hirth
6,085,837 A 7/2000 Massinon et al.
6,095,247 A 8/2000 Streich et al.
6,119,783 A 9/2000 Parker et al.
6,142,237 A 11/2000 Christmas et al.
6,161,622 A 12/2000 Robb
6,167,970 B1 1/2001 Stout et al.
6,170,583 B1 1/2001 Boyce
6,171,359 B1 1/2001 Levinski et al.
6,173,779 B1 1/2001 Smith
6,176,323 B1 1/2001 Weirich et al.
6,189,616 B1 2/2001 Gano et al.
6,189,618 B1 2/2001 Beeman et al.
6,213,202 B1 4/2001 Read, Jr.
6,220,350 B1 4/2001 Brothers et al.
6,220,357 B1 4/2001 Carmichael et al.
6,228,904 B1 5/2001 Yadav et al.
6,237,688 B1 5/2001 Burleson et al.
6,238,280 B1 5/2001 Ritt et al.
6,241,021 B1 6/2001 Bowling
6,248,399 B1 6/2001 Hehmann
6,250,392 B1 6/2001 Muth
6,261,432 B1 7/2001 Huber et al.
6,265,205 B1 7/2001 Hitchens et al.
6,273,187 B1 8/2001 Voisin, Jr. et al.
6,276,452 B1 8/2001 Davis et al.
6,276,457 B1 8/2001 Moffatt et al.
6,279,656 B1 8/2001 Sinclair et al.
6,287,332 B1 9/2001 Bolz et al.
6,287,445 B1 9/2001 Lashmore et al.
6,302,205 B1 10/2001 Ryll
6,315,041 B1 11/2001 Carlisle et al.
6,315,050 B2 11/2001 Vaynshteyn et al.
6,325,148 B1 12/2001 Trahan et al.
6,328,110 B1 12/2001 Joubert
6,341,653 B1 1/2002 Firmaniuk et al.
6,341,747 B1 1/2002 Schmidt et al.
6,349,766 B1 2/2002 Bussear et al.
6,354,372 B1 3/2002 Carisella et al.
6,354,379 B2 3/2002 Miszewski et al.
6,357,322 B1 3/2002 Dolan et al.
6,357,332 B1 3/2002 Vecchio
6,371,206 B1 4/2002 Mills
6,372,346 B1 4/2002 Toth
6,382,244 B2 5/2002 Vann
6,390,195 B1 5/2002 Nguyen et al.
6,390,200 B1 5/2002 Allamon et al.
6,394,180 B1 5/2002 Berscheidt et al.
6,394,185 B1 5/2002 Constien
6,395,402 B1 5/2002 Lambert et al.
6,397,950 B1 6/2002 Streich et al.

(56) References Cited

U.S. PATENT DOCUMENTS

| | | | |
|---|---|---|---|
| 6,401,547 | B1 | 6/2002 | Hatfield et al. |
| 6,403,210 | B1 | 6/2002 | Stuivinga et al. |
| 6,408,946 | B1 | 6/2002 | Marshall et al. |
| 6,419,023 | B1 | 7/2002 | George et al. |
| 6,439,313 | B1 | 8/2002 | Thomeer et al. |
| 6,446,717 | B1 | 9/2002 | White et al. |
| 6,457,525 | B1 | 10/2002 | Scott |
| 6,467,546 | B2 | 10/2002 | Allamon et al. |
| 6,470,965 | B1 | 10/2002 | Winzer |
| 6,491,097 | B1 | 12/2002 | Oneal et al. |
| 6,491,116 | B2 | 12/2002 | Berscheidt et al. |
| 6,513,598 | B2 | 2/2003 | Moore et al. |
| 6,513,600 | B2 | 2/2003 | Ross |
| 6,540,033 | B1 | 4/2003 | Sullivan et al. |
| 6,543,543 | B2 | 4/2003 | Muth |
| 6,561,275 | B2 | 5/2003 | Glass et al. |
| 6,588,507 | B2 | 7/2003 | Dusterhoft et al. |
| 6,591,915 | B2 | 7/2003 | Burris et al. |
| 6,601,648 | B2 | 8/2003 | Ebinger |
| 6,601,650 | B2 | 8/2003 | Sundararajan |
| 6,609,569 | B2 | 8/2003 | Howlett et al. |
| 6,612,826 | B1 | 9/2003 | Bauer et al. |
| 6,613,383 | B1 | 9/2003 | George et al. |
| 6,619,400 | B2 | 9/2003 | Brunet |
| 6,630,008 | B1 | 10/2003 | Meeks, III et al. |
| 6,634,428 | B2 | 10/2003 | Krauss et al. |
| 6,662,886 | B2 | 12/2003 | Russell |
| 6,675,889 | B1 | 1/2004 | Mullins et al. |
| 6,699,305 | B2 | 3/2004 | Myrick |
| 6,712,153 | B2 | 3/2004 | Turley et al. |
| 6,712,797 | B1 | 3/2004 | Southern, Jr. |
| 6,713,177 | B2 | 3/2004 | George et al. |
| 6,715,541 | B2 | 4/2004 | Pedersen et al. |
| 6,719,051 | B2 | 4/2004 | Hailey, Jr. et al. |
| 6,755,249 | B2 | 6/2004 | Robison et al. |
| 6,769,491 | B2 | 8/2004 | Zimmerman et al. |
| 6,776,228 | B2 | 8/2004 | Pedersen et al. |
| 6,779,599 | B2 | 8/2004 | Mullins et al. |
| 6,799,638 | B2 | 10/2004 | Butterfield, Jr. |
| 6,810,960 | B2 | 11/2004 | Pia |
| 6,817,414 | B2 | 11/2004 | Lee |
| 6,831,044 | B2 | 12/2004 | Constien |
| 6,883,611 | B2 | 4/2005 | Smith et al. |
| 6,887,297 | B2 | 5/2005 | Winter et al. |
| 6,896,049 | B2 | 5/2005 | Moyes |
| 6,896,061 | B2 | 5/2005 | Hriscu et al. |
| 6,899,176 | B2 | 5/2005 | Hailey, Jr. et al. |
| 6,899,777 | B2 | 5/2005 | Vaidyanathan et al. |
| 6,908,516 | B2 | 6/2005 | Hehmann et al. |
| 6,913,827 | B2 | 7/2005 | George et al. |
| 6,926,086 | B2 | 8/2005 | Patterson et al. |
| 6,932,159 | B2 | 8/2005 | Hovem |
| 6,939,388 | B2 | 9/2005 | Angeliu |
| 6,945,331 | B2 | 9/2005 | Patel |
| 6,951,331 | B2 | 10/2005 | Haughom et al. |
| 6,959,759 | B2 | 11/2005 | Doane et al. |
| 6,973,970 | B2 | 12/2005 | Johnston et al. |
| 6,973,973 | B2 | 12/2005 | Howard et al. |
| 6,983,796 | B2 | 1/2006 | Bayne et al. |
| 6,986,390 | B2 | 1/2006 | Doane et al. |
| 7,013,989 | B2 | 3/2006 | Hammond et al. |
| 7,013,998 | B2 | 3/2006 | Ray et al. |
| 7,017,664 | B2 | 3/2006 | Walker et al. |
| 7,017,677 | B2 | 3/2006 | Keshavan et al. |
| 7,021,389 | B2 | 4/2006 | Bishop et al. |
| 7,025,146 | B2 | 4/2006 | King et al. |
| 7,028,778 | B2 | 4/2006 | Krywitsky |
| 7,044,230 | B2 | 5/2006 | Starr et al. |
| 7,048,812 | B2 | 5/2006 | Bettles et al. |
| 7,049,272 | B2 | 5/2006 | Sinclair et al. |
| 7,051,805 | B2 | 5/2006 | Doane et al. |
| 7,059,410 | B2 | 6/2006 | Bousche et al. |
| 7,063,748 | B2 | 6/2006 | Talton |
| 7,090,027 | B1 | 8/2006 | Williams |
| 7,093,664 | B2 | 8/2006 | Todd et al. |
| 7,096,945 | B2 | 8/2006 | Richards et al. |
| 7,096,946 | B2 | 8/2006 | Jasser et al. |
| 7,097,807 | B1 | 8/2006 | Meeks, III et al. |
| 7,097,906 | B2 | 8/2006 | Gardner |
| 7,108,080 | B2 | 9/2006 | Tessari et al. |
| 7,111,682 | B2 | 9/2006 | Blaisdell |
| 7,128,145 | B2 | 10/2006 | Mickey |
| 7,141,207 | B2 | 11/2006 | Jandeska, Jr. et al. |
| 7,150,326 | B2 | 12/2006 | Bishop et al. |
| 7,163,066 | B2 | 1/2007 | Lehr |
| 7,165,622 | B2 | 1/2007 | Hirth et al. |
| 7,168,494 | B2 | 1/2007 | Starr et al. |
| 7,174,963 | B2 | 2/2007 | Bertelsen |
| 7,182,135 | B2 | 2/2007 | Szarka |
| 7,188,559 | B1 | 3/2007 | Vecchio |
| 7,210,527 | B2 | 5/2007 | Walker et al. |
| 7,210,533 | B2 | 5/2007 | Starr et al. |
| 7,217,311 | B2 | 5/2007 | Hong et al. |
| 7,234,530 | B2 | 6/2007 | Gass |
| 7,250,188 | B2 | 7/2007 | Dodelet et al. |
| 7,252,162 | B2 | 8/2007 | Akinlade et al. |
| 7,255,172 | B2 | 8/2007 | Johnson |
| 7,255,178 | B2 | 8/2007 | Slup et al. |
| 7,264,060 | B2 | 9/2007 | Wills |
| 7,267,172 | B2 | 9/2007 | Hofman |
| 7,267,178 | B2 | 9/2007 | Krywitsky |
| 7,270,186 | B2 | 9/2007 | Johnson |
| 7,287,592 | B2 | 10/2007 | Surjaatmadja et al. |
| 7,311,152 | B2 | 12/2007 | Howard et al. |
| 7,316,274 | B2 | 1/2008 | Xu et al. |
| 7,320,365 | B2 | 1/2008 | Pia |
| 7,322,412 | B2 | 1/2008 | Badalamenti et al. |
| 7,322,417 | B2 | 1/2008 | Rytlewski et al. |
| 7,325,617 | B2 | 2/2008 | Murray |
| 7,328,750 | B2 | 2/2008 | Swor et al. |
| 7,331,388 | B2 | 2/2008 | Vilela et al. |
| 7,337,854 | B2 | 3/2008 | Horn et al. |
| 7,346,456 | B2 | 3/2008 | Le Bemadjiel |
| 7,350,582 | B2 | 4/2008 | McKeachnie et al. |
| 7,353,867 | B2 | 4/2008 | Carter et al. |
| 7,353,879 | B2 | 4/2008 | Todd et al. |
| 7,360,593 | B2 | 4/2008 | Constien |
| 7,360,597 | B2 | 4/2008 | Blaisdell |
| 7,363,970 | B2 | 4/2008 | Corre et al. |
| 7,373,978 | B2 | 5/2008 | Barry et al. |
| 7,380,600 | B2 | 6/2008 | Willberg et al. |
| 7,384,443 | B2 | 6/2008 | Mirchandani |
| 7,387,158 | B2 | 6/2008 | Murray et al. |
| 7,387,165 | B2 | 6/2008 | Lopez De Cardenas et al. |
| 7,392,841 | B2 | 7/2008 | Murray et al. |
| 7,401,648 | B2 | 7/2008 | Bennett |
| 7,416,029 | B2 | 8/2008 | Telfer et al. |
| 7,422,058 | B2 | 9/2008 | O'Malley |
| 7,426,964 | B2 | 9/2008 | Lynde et al. |
| 7,441,596 | B2 | 10/2008 | Wood et al. |
| 7,445,049 | B2 | 11/2008 | Howard et al. |
| 7,451,815 | B2 | 11/2008 | Hailey, Jr. |
| 7,451,817 | B2 | 11/2008 | Reddy et al. |
| 7,461,699 | B2 | 12/2008 | Richard et al. |
| 7,464,764 | B2 | 12/2008 | Xu |
| 7,472,750 | B2 | 1/2009 | Walker et al. |
| 7,478,676 | B2 | 1/2009 | East, Jr. et al. |
| 7,503,390 | B2 | 3/2009 | Gomez |
| 7,503,399 | B2 | 3/2009 | Badalamenti et al. |
| 7,509,993 | B1 | 3/2009 | Turng et al. |
| 7,510,018 | B2 | 3/2009 | Williamson et al. |
| 7,513,311 | B2 | 4/2009 | Gramstad et al. |
| 7,516,791 | B2 | 4/2009 | Bryant et al. |
| 7,527,103 | B2 | 5/2009 | Huang et al. |
| 7,537,825 | B1 | 5/2009 | Wardle et al. |
| 7,552,777 | B2 | 6/2009 | Murray et al. |
| 7,552,779 | B2 | 6/2009 | Murray |
| 7,559,357 | B2 | 7/2009 | Clem |
| 7,575,062 | B2 | 8/2009 | East, Jr. |
| 7,579,087 | B2 | 8/2009 | Maloney et al. |
| 7,591,318 | B2 | 9/2009 | Tilghman |
| 7,600,572 | B2 | 10/2009 | Slup et al. |
| 7,604,049 | B2 | 10/2009 | Vaidya et al. |
| 7,604,055 | B2 | 10/2009 | Richard et al. |

(56) References Cited

U.S. PATENT DOCUMENTS 7,607,476 B2 10/2009 Tom et al.
7,617,871 B2 11/2009 Surjaatmadja et al.
7,635,023 B2 12/2009 Goldberg et al.
7,640,988 B2 1/2010 Phi et al.
7,661,480 B2 2/2010 Al-Anazi
7,661,481 B2 2/2010 Todd et al.
7,665,537 B2 2/2010 Patel et al.
7,686,082 B2 3/2010 Marsh
7,690,436 B2 4/2010 Turley et al.
7,699,101 B2 4/2010 Fripp et al.
7,703,510 B2 4/2010 Xu
7,703,511 B2 4/2010 Buyers et al.
7,708,078 B2 5/2010 Stoesz
7,709,421 B2 5/2010 Jones et al.
7,712,541 B2 5/2010 Loretz et al.
7,723,272 B2 5/2010 Crews et al.
7,726,406 B2 6/2010 Xu
7,735,578 B2 6/2010 Loehr et al.
7,743,836 B2 6/2010 Cook et al.
7,752,971 B2 7/2010 Loehr
7,757,773 B2 7/2010 Rytlewski
7,762,342 B2 7/2010 Richard et al.
7,770,652 B2 8/2010 Barnett
7,771,289 B2 8/2010 Palumbo et al.
7,775,284 B2 8/2010 Richards et al.
7,775,285 B2 8/2010 Surjaatmadja et al.
7,775,286 B2 8/2010 Duphorne
7,784,543 B2 8/2010 Johnson
7,793,714 B2 9/2010 Johnson
7,798,225 B2 9/2010 Giroux et al.
7,798,226 B2 9/2010 Themig
7,798,236 B2 9/2010 McKeachnie et al.
7,806,189 B2 10/2010 Frazier
7,806,192 B2 10/2010 Foster et al.
7,810,553 B2 10/2010 Cruickshank et al.
7,810,567 B2 10/2010 Daniels et al.
7,819,198 B2 10/2010 Birckhead et al.
7,828,055 B2 11/2010 Willauer et al.
7,833,944 B2 11/2010 Munoz et al.
7,849,927 B2 12/2010 Herrera
7,851,016 B2 12/2010 Arbab et al.
7,855,168 B2 12/2010 Fuller et al.
7,861,779 B2 1/2011 Vestavik
7,861,781 B2 1/2011 D'Arcy
7,874,365 B2 1/2011 East, Jr. et al.
7,878,253 B2 2/2011 Stowe et al.
7,879,367 B2 2/2011 Heublein et al.
7,896,091 B2 3/2011 Williamson et al.
7,897,063 B1 3/2011 Perry et al.
7,900,696 B1 3/2011 Nish et al.
7,900,703 B2 3/2011 Clark et al.
7,909,096 B2 3/2011 Clark et al.
7,909,104 B2 3/2011 Bjorgum
7,909,110 B2 3/2011 Sharma et al.
7,909,115 B2 3/2011 Grove et al.
7,913,765 B2 3/2011 Crow et al.
7,918,275 B2 4/2011 Clem
7,931,093 B2 4/2011 Foster et al.
7,938,191 B2 5/2011 Vaidya
7,946,335 B2 5/2011 Bewlay et al.
7,946,340 B2 5/2011 Surjaatmadja et al.
7,958,940 B2 6/2011 Jameson
7,963,331 B2 6/2011 Surjaatmadja et al.
7,963,340 B2 6/2011 Gramstad et al.
7,963,342 B2 6/2011 George
7,980,300 B2 7/2011 Roberts et al.
7,987,906 B1 8/2011 Troy
7,992,763 B2 8/2011 Vecchio et al.
8,002,821 B2 8/2011 Stinson
8,020,619 B1 9/2011 Robertson et al.
8,020,620 B2 9/2011 Daniels et al.
8,025,104 B2 9/2011 Cooke, Jr.
8,028,767 B2 10/2011 Radford et al.
8,033,331 B2 10/2011 Themig
8,039,422 B1 10/2011 Al-Zahrani
8,056,628 B2 11/2011 Whitsitt et al.
8,056,638 B2 11/2011 Clayton et al.
8,109,340 B2 2/2012 Doane et al.
8,114,148 B2 2/2012 Atanasoska et al.
8,127,856 B1 3/2012 Nish et al.
8,153,052 B2 4/2012 Jackson et al.
8,163,060 B2 4/2012 Imanishi et al.
8,211,247 B2 7/2012 Marya et al.
8,211,248 B2 7/2012 Marya
8,220,554 B2 7/2012 Jordan et al.
8,226,740 B2 7/2012 Chaumonnot et al.
8,230,731 B2 7/2012 Dyer et al.
8,231,947 B2 7/2012 Vaidya et al.
8,263,178 B2 9/2012 Boulos et al.
8,276,670 B2 10/2012 Patel
8,277,974 B2 10/2012 Kumar et al.
8,297,364 B2 10/2012 Agrawal et al.
8,327,931 B2 12/2012 Agrawal et al.
8,403,037 B2 3/2013 Agrawal et al.
8,413,727 B2 4/2013 Holmes
8,425,651 B2 4/2013 Xu et al.
8,459,347 B2 6/2013 Stout
8,486,329 B2 7/2013 Shikai et al.
8,490,674 B2 7/2013 Stevens et al.
8,490,689 B1 7/2013 McClinton et al.
8,535,604 B1 9/2013 Baker et al.
8,573,295 B2 11/2013 Johnson et al.
8,631,876 B2 1/2014 Xu et al.
8,663,401 B2 3/2014 Marya et al.
8,715,339 B2 5/2014 Atanasoska et al.
8,734,602 B2 5/2014 Li et al.
8,770,261 B2 7/2014 Marya
8,905,147 B2 12/2014 Fripp et al.
8,956,660 B2 2/2015 Launag et al.
8,998,978 B2 4/2015 Wang
9,044,397 B2 6/2015 Choi et al.
9,057,117 B2 6/2015 Harrison et al.
9,057,242 B2 6/2015 Mazyar et al.
9,079,246 B2 7/2015 Xu et al.
9,080,098 B2 7/2015 Xu et al.
9,089,408 B2 7/2015 Xu
9,090,955 B2 7/2015 Xu et al.
9,101,978 B2 8/2015 Xu et al.
9,109,429 B2 8/2015 Xu et al.
9,119,906 B2 9/2015 Tomantschger et al.
9,163,467 B2 10/2015 Gaudette et al.
9,211,586 B1 12/2015 Lavernia et al.
9,243,475 B2 1/2016 Xu
9,260,935 B2 2/2016 Murphree et al.
9,682,425 B2 6/2017 Xu et al.
2001/0040180 A1 11/2001 Wittebrood et al.
2001/0045285 A1 11/2001 Russell
2001/0045288 A1 11/2001 Allamon et al.
2002/0000319 A1 1/2002 Brunet
2002/0007948 A1 1/2002 Bayne et al.
2002/0014268 A1 2/2002 Vann
2002/0020527 A1 2/2002 Kilaas et al.
2002/0047058 A1 4/2002 Verhoff et al.
2002/0066572 A1 6/2002 Muth
2002/0092654 A1 7/2002 Coronado et al.
2002/0096365 A1 7/2002 Berscheidt et al.
2002/0104616 A1 8/2002 De et al.
2002/0108756 A1 8/2002 Harrall et al.
2002/0136904 A1 9/2002 Glass et al.
2002/0139541 A1 10/2002 Sheffield et al.
2002/0162661 A1 11/2002 Krauss et al.
2003/0019639 A1 1/2003 MacKay
2003/0037925 A1 2/2003 Walker et al.
2003/0060374 A1 3/2003 Cooke, Jr.
2003/0075326 A1 4/2003 Ebinger
2003/0104147 A1 6/2003 Bretschneider et al.
2003/0111728 A1 6/2003 Thai et al.
2003/0127013 A1 7/2003 Zavitsanos et al.
2003/0141060 A1 7/2003 Hailey et al.
2003/0141061 A1 7/2003 Hailey et al.
2003/0141079 A1 7/2003 Doane et al.
2003/0150614 A1 8/2003 Brown et al.
2003/0155114 A1 8/2003 Pedersen et al.
2003/0155115 A1 8/2003 Pedersen et al.

(56) References Cited

U.S. PATENT DOCUMENTS

| | | | |
|---|---|---|---|
| 2003/0159828 | A1 | 8/2003 | Howard et al. |
| 2003/0164237 | A1 | 9/2003 | Butterfield |
| 2003/0183391 | A1 | 10/2003 | Hriscu et al. |
| 2003/0226668 | A1 | 12/2003 | Zimmerman et al. |
| 2004/0005483 | A1 | 1/2004 | Lin |
| 2004/0020832 | A1 | 2/2004 | Richards et al. |
| 2004/0031605 | A1 | 2/2004 | Mickey |
| 2004/0045723 | A1 | 3/2004 | Slup et al. |
| 2004/0055758 | A1 | 3/2004 | Brezinski et al. |
| 2004/0058167 | A1 | 3/2004 | Arbab et al. |
| 2004/0069502 | A1 | 4/2004 | Luke |
| 2004/0089449 | A1 | 5/2004 | Walton et al. |
| 2004/0094297 | A1 | 5/2004 | Malone et al. |
| 2004/0154806 | A1 | 8/2004 | Bode et al. |
| 2004/0159428 | A1 | 8/2004 | Hammond et al. |
| 2004/0159446 | A1 | 8/2004 | Haugen et al. |
| 2004/0182583 | A1 | 9/2004 | Doane et al. |
| 2004/0216868 | A1 | 11/2004 | Owen, Sr. |
| 2004/0231845 | A1 | 11/2004 | Cooke, Jr. |
| 2004/0251025 | A1 | 12/2004 | Giroux et al. |
| 2004/0256109 | A1 | 12/2004 | Johnson |
| 2004/0256157 | A1 | 12/2004 | Tessari et al. |
| 2004/0261993 | A1 | 12/2004 | Nguyen |
| 2004/0261994 | A1 | 12/2004 | Nguyen et al. |
| 2005/0034876 | A1 | 2/2005 | Doane et al. |
| 2005/0051329 | A1 | 3/2005 | Blaisdell |
| 2005/0064247 | A1 | 3/2005 | Sane et al. |
| 2005/0069449 | A1 | 3/2005 | Jackson et al. |
| 2005/0074612 | A1 | 4/2005 | Eklund et al. |
| 2005/0098313 | A1 | 5/2005 | Atkins et al. |
| 2005/0102255 | A1 | 5/2005 | Bultman |
| 2005/0106316 | A1 | 5/2005 | Rigney et al. |
| 2005/0126334 | A1 | 6/2005 | Mirchandani |
| 2005/0161212 | A1 | 7/2005 | Leismer et al. |
| 2005/0161224 | A1 | 7/2005 | Starr et al. |
| 2005/0165149 | A1 | 7/2005 | Chanak et al. |
| 2005/0194143 | A1 | 9/2005 | Xu et al. |
| 2005/0199401 | A1 | 9/2005 | Patel et al. |
| 2005/0205264 | A1 | 9/2005 | Starr et al. |
| 2005/0205265 | A1 | 9/2005 | Todd et al. |
| 2005/0205266 | A1 | 9/2005 | Todd et al. |
| 2005/0235757 | A1 | 10/2005 | De Jonge et al. |
| 2005/0241824 | A1 | 11/2005 | Burris, II et al. |
| 2005/0241825 | A1 | 11/2005 | Burris, II et al. |
| 2005/0257936 | A1 | 11/2005 | Lehr |
| 2005/0268746 | A1 | 12/2005 | Abkowitz et al. |
| 2005/0269097 | A1 | 12/2005 | Towler |
| 2005/0275143 | A1 | 12/2005 | Toth |
| 2005/0279501 | A1 | 12/2005 | Surjaatmadja et al. |
| 2006/0012087 | A1 | 1/2006 | Matsuda et al. |
| 2006/0013350 | A1 | 1/2006 | Akers |
| 2006/0045787 | A1 | 3/2006 | Jandeska et al. |
| 2006/0057479 | A1 | 3/2006 | Niimi et al. |
| 2006/0081378 | A1 | 4/2006 | Howard et al. |
| 2006/0102871 | A1 | 5/2006 | Wang |
| 2006/0108114 | A1 | 5/2006 | Johnson et al. |
| 2006/0108126 | A1 | 5/2006 | Horn et al. |
| 2006/0110615 | A1 | 5/2006 | Karim et al. |
| 2006/0116696 | A1 | 6/2006 | Odermatt et al. |
| 2006/0124310 | A1 | 6/2006 | Lopez De Cardenas et al. |
| 2006/0131011 | A1 | 6/2006 | Lynde et al. |
| 2006/0131031 | A1 | 6/2006 | McKeachnie et al. |
| 2006/0131081 | A1 | 6/2006 | Mirchandani et al. |
| 2006/0134312 | A1 | 6/2006 | Rytlewski et al. |
| 2006/0144515 | A1 | 7/2006 | Tada et al. |
| 2006/0150770 | A1 | 7/2006 | Freim |
| 2006/0151178 | A1 | 7/2006 | Howard et al. |
| 2006/0153728 | A1 | 7/2006 | Schoenung et al. |
| 2006/0162927 | A1 | 7/2006 | Walker et al. |
| 2006/0169453 | A1 | 8/2006 | Savery et al. |
| 2006/0186602 | A1 | 8/2006 | Martin et al. |
| 2006/0207763 | A1 | 9/2006 | Hofman et al. |
| 2006/0213670 | A1 | 9/2006 | Bishop et al. |
| 2006/0231253 | A1 | 10/2006 | Vilela et al. |
| 2006/0269437 | A1 | 11/2006 | Pandey |
| 2006/0283592 | A1 | 12/2006 | Sierra et al. |
| 2007/0017674 | A1 | 1/2007 | Blaisdell |
| 2007/0017675 | A1 | 1/2007 | Hammami |
| 2007/0029082 | A1 | 2/2007 | Giroux et al. |
| 2007/0039161 | A1 | 2/2007 | Garcia |
| 2007/0039741 | A1 | 2/2007 | Hailey |
| 2007/0044958 | A1 | 3/2007 | Rytlewski et al. |
| 2007/0044966 | A1 | 3/2007 | Davies et al. |
| 2007/0051521 | A1 | 3/2007 | Fike et al. |
| 2007/0053785 | A1 | 3/2007 | Hetz et al. |
| 2007/0054101 | A1 | 3/2007 | Sigalas et al. |
| 2007/0057415 | A1 | 3/2007 | Katagiri et al. |
| 2007/0062644 | A1 | 3/2007 | Nakamura et al. |
| 2007/0074601 | A1 | 4/2007 | Hong et al. |
| 2007/0074873 | A1 | 4/2007 | McKeachnie et al. |
| 2007/0102199 | A1 | 5/2007 | Smith et al. |
| 2007/0107899 | A1 | 5/2007 | Werner et al. |
| 2007/0107908 | A1 | 5/2007 | Vaidya et al. |
| 2007/0108060 | A1 | 5/2007 | Park |
| 2007/0119600 | A1 | 5/2007 | Slup et al. |
| 2007/0131912 | A1 | 6/2007 | Simone et al. |
| 2007/0134496 | A1 | 6/2007 | Ka |
| 2007/0151009 | A1 | 7/2007 | Conrad, III et al. |
| 2007/0151769 | A1 | 7/2007 | Slutz et al. |
| 2007/0169935 | A1 | 7/2007 | Akbar et al. |
| 2007/0181224 | A1 | 8/2007 | Marya et al. |
| 2007/0185655 | A1 | 8/2007 | Le Bemadjiel |
| 2007/0187095 | A1 | 8/2007 | Walker et al. |
| 2007/0207182 | A1 | 9/2007 | Weber et al. |
| 2007/0221373 | A1 | 9/2007 | Murray |
| 2007/0221384 | A1 | 9/2007 | Murray |
| 2007/0227745 | A1 | 10/2007 | Roberts et al. |
| 2007/0259994 | A1 | 11/2007 | Tour et al. |
| 2007/0261862 | A1 | 11/2007 | Murray |
| 2007/0270942 | A1 | 11/2007 | Thomas |
| 2007/0272411 | A1 | 11/2007 | Lopez De Cardenas et al. |
| 2007/0272413 | A1 | 11/2007 | Rytlewski et al. |
| 2007/0277979 | A1 | 12/2007 | Todd et al. |
| 2007/0284109 | A1 | 12/2007 | East et al. |
| 2007/0284112 | A1 | 12/2007 | Magne et al. |
| 2007/0299510 | A1 | 12/2007 | Venkatraman et al. |
| 2008/0011473 | A1 | 1/2008 | Wood et al. |
| 2008/0020923 | A1 | 1/2008 | Debe et al. |
| 2008/0047707 | A1 | 2/2008 | Boney et al. |
| 2008/0060810 | A9 | 3/2008 | Nguyen et al. |
| 2008/0066923 | A1 | 3/2008 | Xu |
| 2008/0066924 | A1 | 3/2008 | Xu |
| 2008/0072705 | A1 | 3/2008 | Chaumonnot et al. |
| 2008/0078553 | A1 | 4/2008 | George |
| 2008/0081866 | A1 | 4/2008 | Gong et al. |
| 2008/0093073 | A1 | 4/2008 | Bustos et al. |
| 2008/0099209 | A1 | 5/2008 | Loretz et al. |
| 2008/0105438 | A1 | 5/2008 | Jordan et al. |
| 2008/0115932 | A1 | 5/2008 | Cooke |
| 2008/0121390 | A1 | 5/2008 | O'Malley et al. |
| 2008/0121436 | A1 | 5/2008 | Slay et al. |
| 2008/0127475 | A1 | 6/2008 | Griffo |
| 2008/0135249 | A1 | 6/2008 | Fripp et al. |
| 2008/0149325 | A1 | 6/2008 | Crawford |
| 2008/0149345 | A1 | 6/2008 | Bicerano |
| 2008/0149351 | A1 | 6/2008 | Marya et al. |
| 2008/0169105 | A1 | 7/2008 | Williamson et al. |
| 2008/0169130 | A1 | 7/2008 | Norman et al. |
| 2008/0179060 | A1 | 7/2008 | Surjaatmadja et al. |
| 2008/0179104 | A1 | 7/2008 | Zhang et al. |
| 2008/0196801 | A1 | 8/2008 | Zhao et al. |
| 2008/0202764 | A1 | 8/2008 | Clayton et al. |
| 2008/0202814 | A1 | 8/2008 | Lyons et al. |
| 2008/0210473 | A1 | 9/2008 | Zhang et al. |
| 2008/0216383 | A1 | 9/2008 | Pierick et al. |
| 2008/0223586 | A1 | 9/2008 | Barnett |
| 2008/0223587 | A1 | 9/2008 | Cherewyk |
| 2008/0236829 | A1 | 10/2008 | Lynde |
| 2008/0236842 | A1 | 10/2008 | Bhavsar et al. |
| 2008/0248205 | A1 | 10/2008 | Blanchet et al. |
| 2008/0248413 | A1 | 10/2008 | Ishii et al. |
| 2008/0264205 | A1 | 10/2008 | Zeng et al. |
| 2008/0264594 | A1 | 10/2008 | Lohmueller et al. |
| 2008/0277109 | A1 | 11/2008 | Vaidya |

(56) References Cited

U.S. PATENT DOCUMENTS

2008/0277980 A1 11/2008 Koda et al.
2008/0282924 A1 11/2008 Saenger et al.
2008/0296024 A1 12/2008 Tianping et al.
2008/0302538 A1 12/2008 Hofman
2008/0314581 A1 12/2008 Brown
2008/0314588 A1 12/2008 Langlais et al.
2009/0038858 A1 2/2009 Griffo et al.
2009/0044946 A1 2/2009 Schasteen et al.
2009/0044949 A1 2/2009 King et al.
2009/0050334 A1 2/2009 Marya et al.
2009/0056934 A1 3/2009 Xu
2009/0065216 A1 3/2009 Frazier
2009/0068051 A1 3/2009 Gross
2009/0074603 A1 3/2009 Chan et al.
2009/0084553 A1 4/2009 Rytlewski et al.
2009/0084556 A1 4/2009 Richards et al.
2009/0084600 A1 4/2009 Severance
2009/0090440 A1 4/2009 Kellett et al.
2009/0107684 A1 4/2009 Cooke, Jr.
2009/0114381 A1 5/2009 Stroobants
2009/0114382 A1 5/2009 Grove et al.
2009/0126436 A1 5/2009 Fly et al.
2009/0139720 A1 6/2009 Frazier
2009/0145666 A1 6/2009 Radford et al.
2009/0151949 A1 6/2009 Marya et al.
2009/0152009 A1 6/2009 Slay et al.
2009/0155616 A1 6/2009 Thamida et al.
2009/0159289 A1 6/2009 Avant et al.
2009/0178808 A1 7/2009 Williamson et al.
2009/0194273 A1 8/2009 Surjaatmadja et al.
2009/0194745 A1 8/2009 Tanaka et al.
2009/0205841 A1 8/2009 Kluge et al.
2009/0211770 A1 8/2009 Nutley et al.
2009/0226340 A1 9/2009 Marya
2009/0226704 A1 9/2009 Kauppinen et al.
2009/0242202 A1 10/2009 Rispler et al.
2009/0242208 A1 10/2009 Bolding
2009/0242214 A1 10/2009 Foster et al.
2009/0255667 A1 10/2009 Clem et al.
2009/0255684 A1 10/2009 Bolding
2009/0255686 A1 10/2009 Richard
2009/0266548 A1 10/2009 Olsen et al.
2009/0260817 A1 11/2009 Gambier et al.
2009/0272544 A1 11/2009 Giroux et al.
2009/0283270 A1 11/2009 Langeslag
2009/0293672 A1 12/2009 Mirchandani et al.
2009/0301730 A1 12/2009 Gweily
2009/0305131 A1 12/2009 Kumar et al.
2009/0308588 A1 12/2009 Howell et al.
2009/0317556 A1 12/2009 MacAry
2009/0317622 A1 12/2009 Huang et al.
2010/0003536 A1 1/2010 Smith et al.
2010/0012385 A1 1/2010 Drivdahl et al.
2010/0015002 A1 1/2010 Barrera et al.
2010/0015469 A1 1/2010 Romanowski et al.
2010/0025255 A1 2/2010 Su et al.
2010/0032151 A1 2/2010 Duphorne et al.
2010/0034857 A1 2/2010 Launag et al.
2010/0038076 A1 2/2010 Spray et al.
2010/0038595 A1 2/2010 Imholt et al.
2010/0040180 A1 2/2010 Kim et al.
2010/0044041 A1 2/2010 Smith et al.
2010/0051278 A1 3/2010 Mytopher et al.
2010/0055491 A1 3/2010 Vecchio et al.
2010/0055492 A1 3/2010 Barsoum et al.
2010/0089583 A1 4/2010 Xu et al.
2010/0089587 A1 4/2010 Stout
2010/0101803 A1 4/2010 Clayton et al.
2010/0116495 A1 5/2010 Spray
2010/0122817 A1 5/2010 Surjaatmadja et al.
2010/0139930 A1 6/2010 Patel et al.
2010/0200230 A1 8/2010 East, Jr. et al.
2010/0209288 A1 8/2010 Marya
2010/0236793 A1 9/2010 Bjorgum
2010/0236794 A1 9/2010 Duan et al.
2010/0243254 A1 9/2010 Murphy et al.
2010/0252273 A1 10/2010 Duphorne
2010/0252280 A1 10/2010 Swor et al.
2010/0270031 A1 10/2010 Patel
2010/0276136 A1 11/2010 Evans et al.
2010/0276159 A1 11/2010 Mailand et al.
2010/0282338 A1 11/2010 Gerrard et al.
2010/0282469 A1 11/2010 Richard et al.
2010/0294510 A1 11/2010 Holmes
2010/0297432 A1 11/2010 Sherman et al.
2010/0304182 A1 12/2010 Facchini et al.
2010/0314105 A1 12/2010 Rose
2010/0314126 A1 12/2010 Kellner
2010/0319427 A1 12/2010 Lohbeck
2010/0319870 A1 12/2010 Bewlay et al.
2010/0326650 A1 12/2010 Tran et al.
2011/0005773 A1 1/2011 Dusterhoft et al.
2011/0036592 A1 2/2011 Fay
2011/0048743 A1 3/2011 Stafford et al.
2011/0052805 A1 3/2011 Bordere et al.
2011/0056692 A1 3/2011 Lopez De Cardenas et al.
2011/0056702 A1 3/2011 Sharma et al.
2011/0067872 A1 3/2011 Agrawal
2011/0067889 A1 3/2011 Marya et al.
2011/0067890 A1 3/2011 Themig
2011/0094406 A1 4/2011 Marya et al.
2011/0100643 A1 5/2011 Themig et al.
2011/0127044 A1 6/2011 Radford et al.
2011/0132143 A1 6/2011 Xu et al.
2011/0132612 A1 6/2011 Agrawal et al.
2011/0132619 A1 6/2011 Agrawal et al.
2011/0132620 A1 6/2011 Agrawal et al.
2011/0132621 A1 6/2011 Agrawal et al.
2011/0135530 A1 6/2011 Xu et al.
2011/0135805 A1 6/2011 Doucet et al.
2011/0135953 A1 6/2011 Xu et al.
2011/0136707 A1 6/2011 Xu et al.
2011/0139465 A1 6/2011 Tibbles et al.
2011/0147014 A1 6/2011 Chen et al.
2011/0186306 A1 8/2011 Marya et al.
2011/0192613 A1 8/2011 Garcia et al.
2011/0214881 A1 9/2011 Newton
2011/0247833 A1 10/2011 Todd et al.
2011/0253387 A1 10/2011 Ervin
2011/0256356 A1 10/2011 Tomantschger et al.
2011/0259610 A1 10/2011 Shkurti et al.
2011/0277987 A1 11/2011 Frazier
2011/0277989 A1 11/2011 Frazier
2011/0277996 A1 11/2011 Cullick et al.
2011/0284232 A1 11/2011 Huang
2011/0284240 A1 11/2011 Chen et al.
2011/0284243 A1 11/2011 Frazier
2011/0300403 A1 12/2011 Vecchio et al.
2011/0314881 A1 12/2011 Hatcher et al.
2012/0024109 A1 2/2012 Xu et al.
2012/0046732 A1 2/2012 Sillekens et al.
2012/0067426 A1 3/2012 Soni et al.
2012/0090839 A1 4/2012 Rudic
2012/0103135 A1 5/2012 Xu et al.
2012/0107590 A1 5/2012 Xu et al.
2012/0118583 A1 5/2012 Johnson et al.
2012/0130470 A1 5/2012 Agnew
2012/0145378 A1 6/2012 Frazier et al.
2012/0145389 A1 6/2012 Fitzpatrick, Jr.
2012/0168152 A1 7/2012 Casciaro et al.
2012/0177905 A1 7/2012 Seals et al.
2012/0205120 A1 8/2012 Howell
2012/0205872 A1 8/2012 Reinhardt et al.
2012/0211239 A1 8/2012 Kritzler et al.
2012/0234546 A1 9/2012 Xu et al.
2012/0234547 A1 9/2012 O'Malley et al.
2012/0267101 A1 10/2012 Cooke
2012/0269673 A1 10/2012 Koo et al.
2012/0292053 A1 11/2012 Xu et al.
2012/0318513 A1 12/2012 Mazyar et al.
2013/0004847 A1 1/2013 Kumar et al.
2013/0008671 A1 1/2013 Booth et al.
2013/0025409 A1 1/2013 Xu
2013/0029886 A1 1/2013 Mazyar et al.

(56) References Cited

U.S. PATENT DOCUMENTS

| | | | |
|---|---|---|---|
| 2013/0032357 | A1 | 2/2013 | Mazyar et al. |
| 2013/0048304 | A1 | 2/2013 | Agrawal et al. |
| 2013/0048305 | A1 | 2/2013 | Xu et al. |
| 2013/0052472 | A1 | 2/2013 | Xu |
| 2013/0068461 | A1 | 3/2013 | Maerz et al. |
| 2013/0081814 | A1 | 4/2013 | Gaudette et al. |
| 2013/0084643 | A1 | 4/2013 | Commarieu et al. |
| 2013/0105159 | A1 | 5/2013 | Alvarez |
| 2013/0126190 | A1 | 5/2013 | Mazyar et al. |
| 2013/0133897 | A1 | 5/2013 | Baihly et al. |
| 2013/0144290 | A1 | 6/2013 | Schiffl et al. |
| 2013/0146144 | A1 | 6/2013 | Joseph et al. |
| 2013/0146302 | A1 | 6/2013 | Gaudette et al. |
| 2013/0167502 | A1 | 7/2013 | Wilson et al. |
| 2013/0168257 | A1 | 7/2013 | Mazyar et al. |
| 2013/0186626 | A1 | 7/2013 | Aitken et al. |
| 2013/0240200 | A1 | 9/2013 | Frazier |
| 2013/0240203 | A1 | 9/2013 | Frazier |
| 2013/0277044 | A1 | 10/2013 | King et al. |
| 2013/0299185 | A1 | 11/2013 | Xu et al. |
| 2013/0299192 | A1 | 11/2013 | Xu et al. |
| 2013/0300066 | A1 | 11/2013 | Xu et al. |
| 2013/0310961 | A1 | 11/2013 | Intriago Velez |
| 2013/0319668 | A1 | 12/2013 | Tschetter et al. |
| 2013/0327540 | A1 | 12/2013 | Hamid et al. |
| 2014/0014339 | A1 | 1/2014 | O'Malley et al. |
| 2014/0020712 | A1 | 1/2014 | Benson |
| 2014/0027128 | A1 | 1/2014 | Johnson et al. |
| 2014/0060834 | A1 | 3/2014 | Quintero et al. |
| 2014/0116711 | A1 | 5/2014 | Tang et al. |
| 2014/0124216 | A1 | 5/2014 | Fripp et al. |
| 2014/0154341 | A1 | 6/2014 | Manuel et al. |
| 2014/0186207 | A1 | 7/2014 | Bae et al. |
| 2014/0190705 | A1 | 7/2014 | Fripp et al. |
| 2014/0196899 | A1 | 7/2014 | Jordan et al. |
| 2014/0224507 | A1 | 8/2014 | Fripp et al. |
| 2014/0262327 | A1 | 9/2014 | Xu et al. |
| 2014/0284063 | A1 | 9/2014 | Fripp et al. |
| 2014/0311731 | A1 | 10/2014 | Smith |
| 2014/0332231 | A1 | 11/2014 | Themig et al. |
| 2014/0360728 | A1 | 12/2014 | Tashiro et al. |
| 2015/0060085 | A1 | 3/2015 | Xu |
| 2015/0065401 | A1 | 3/2015 | Xu et al. |
| 2015/0093589 | A1 | 4/2015 | Mazyar et al. |
| 2015/0240337 | A1 | 8/2015 | Sherman et al. |
| 2015/0247376 | A1 | 9/2015 | Tolman et al. |
| 2015/0299838 | A1 | 10/2015 | Doud et al. |
| 2016/0001366 | A1 | 1/2016 | Xu et al. |
| 2016/0128849 | A1 | 5/2016 | Sirhan et al. |
| 2016/0209391 | A1 | 7/2016 | Zhang et al. |
| 2016/0258242 | A1 | 9/2016 | Hayter et al. |
| 2016/0272882 | A1 | 9/2016 | Stray et al. |
| 2017/0044675 | A1 | 2/2017 | Xu et al. |
| 2017/0165745 | A1 | 6/2017 | Salinas et al. |

FOREIGN PATENT DOCUMENTS

| | | | |
|---|---|---|---|
| CN | 1076968 | A | 10/1993 |
| CN | 1079234 | A | 12/1993 |
| CN | 1255879 | A | 6/2000 |
| CN | 2658384 | Y | 11/2004 |
| CN | 1668545 | A | 9/2005 |
| CN | 1882759 | A1 | 12/2006 |
| CN | 101050417 | A | 10/2007 |
| CN | 101351523 | A | 1/2009 |
| CN | 101454074 | A | 6/2009 |
| CN | 101457321 | A | 6/2009 |
| CN | 101605963 | | 12/2009 |
| EA | 008390 | B1 | 4/2007 |
| EA | 200870227 | A1 | 2/2009 |
| EP | 0033625 | A1 | 8/1981 |
| EP | 1006258 | A2 | 6/2000 |
| EP | 1174385 | A2 | 1/2002 |
| EP | 1412175 | A1 | 4/2004 |
| EP | 1798301 | A1 | 8/2006 |
| EP | 1857570 | A2 | 11/2007 |
| FR | 2782096 | A1 | 2/2000 |
| GB | 912956 | | 12/1962 |
| GB | 1046330 | A | 10/1966 |
| GB | 1280833 | A | 7/1972 |
| GB | 1357065 | A | 6/1974 |
| JP | 61067770 | | 4/1986 |
| JP | 754008 | A | 2/1995 |
| JP | 8232029 | A | 9/1996 |
| JP | 2000073152 | A | 3/2000 |
| JP | 2000185725 | A1 | 7/2000 |
| JP | 2002053902 | A | 2/2002 |
| JP | 2004154837 | A | 6/2004 |
| JP | 2004225084 | A | 8/2004 |
| JP | 2004225765 | A | 8/2004 |
| JP | 2005076052 | A | 3/2005 |
| JP | 2009144207 | A | 7/2009 |
| JP | 2010502840 | A | 1/2010 |
| KR | 950014350 | B1 | 11/1995 |
| RU | 2373375 | C2 | 11/2009 |
| WO | 9111587 | A1 | 8/1991 |
| WO | 9909227 | A1 | 2/1999 |
| WO | 9947726 | | 9/1999 |
| WO | 03008186 | A1 | 1/2003 |
| WO | 2004001087 | A1 | 12/2003 |
| WO | 2004073889 | A1 | 9/2004 |
| WO | 2005040068 | A | 5/2005 |
| WO | 2007044635 | A | 4/2007 |
| WO | 2007095376 | A2 | 8/2007 |
| WO | 2008017156 | A1 | 2/2008 |
| WO | 2008034042 | A3 | 3/2008 |
| WO | 2008057045 | A1 | 5/2008 |
| WO | 2008079485 | A2 | 7/2008 |
| WO | 2008079777 | A2 | 7/2008 |
| WO | 2008142129 | | 11/2008 |
| WO | 2009079745 | A1 | 7/2009 |
| WO | 2010012184 | A1 | 2/2010 |
| WO | 2010083826 | | 7/2010 |
| WO | 2011071902 | A2 | 6/2011 |
| WO | 2011071907 | A2 | 6/2011 |
| WO | 2011071910 | A3 | 6/2011 |
| WO | 2011130063 | A3 | 2/2012 |
| WO | 2012015567 | A2 | 2/2012 |
| WO | 2012071449 | A2 | 5/2012 |
| WO | 2012149007 | A2 | 11/2012 |
| WO | 2012164236 | A1 | 12/2012 |
| WO | 2012174101 | A2 | 12/2012 |
| WO | 2012175665 | A1 | 12/2012 |
| WO | 2013053057 | A1 | 4/2013 |
| WO | 2013078031 | A1 | 5/2013 |
| WO | 2014121384 | A1 | 8/2014 |
| WO | 2015171585 | | 11/2015 |
| WO | 2016032493 | | 3/2016 |
| WO | 2016085798 | | 6/2016 |

OTHER PUBLICATIONS

"Baker Hughes Refines Expandable Tubular Technology with Abaqus and Isight", Simulia Realistic Simulation News, Jan./Feb. 2011, pp. 12-13.

"Optisleeve Sliding Sleeve", [online]; [retrieved on Jun. 25, 2010]; retrieved from the Internet weatherford.com/weatherford/groups/.../weatherfordcorp/WFT033159.pdf.

"Reactivity series", Wikipedia, http://en.wikipedia.org/w/index.php?title=Reactivity_series&printable=yes downloaded on May 18, 2014. 8 pages.

"Sliding Sleeve", Omega Completion Technology Ltd, Sep. 29, 2009, retrieved on: www.omega-completion.com.

Adams, et al.; "Thermal stabilities of aromatic acids as geothermal tracers", Geothermics, vol. 21, No. 3, 1992, pp. 323-339.

Ambat, et al., "Electroless Nickel-Plating on AZ91D Magnesium Alloy: Effect of Substrate Microstructure and Plating Parameters"; Surface and Coatings Technology; 179; pp. 124-134; (2004).

Australian Examination Report for Australian patent application No. 2012302067 dated Sep. 22, 2015, 3 pages.

Australian Examination Report; Australian Application No. 2012287461; dated Jul. 13, 2015; 6 pages.

(56) References Cited

OTHER PUBLICATIONS

Ayman, et al.; "Effect of Consolidation and Extrusion Temperatures on Tensile Properties of Hot Extruded ZK61 Magnesium Alloy Gas Atomized Powders via Spark Plasma Sintering", Transactions of JWRI, vol. 38 (2009), No. 2, pp. 1-5.
Baker Hughes Incorporated. IN-Tallic Disintegrating Frac Balls. Houston: Baker Hughes Incorporated, 2011. Accessed Mar. 6, 2015.
Baker Hughes, "Flow Control Systems," [online]; [retrieved on May 20, 2010]; retrieved from the Internet http://www.bakerhughes.com/products-and-services/completions-and-productions/well-completions/packers-and-flow-control/flow-control-systems.
Baker Hughes, "Multistage", Oct. 31, 2011, BakerHughes.com; accessed Mar. 6, 2015.
Baker Oil Tools, "Baker Oil Tools Introduces Revolutionary Sand Control Completion Technology," May 2, 2005.
Baker Oil Tools, "Z-Seal Metal-to-Metal Expandable Sealing Device Uses Expanding Metal in Place of Elastomers," Nov. 6, 2006.
Bakshi et al., "Carbon nanotube reinforced metal matrix composites—a review," International Materials Reviews; 2010, pp. 41-64, vol. 55, No. 1.
Bastow, et al., "Clustering and formation of nano-precipitates in dilute aluminum and magnesium alloys", Materials Science and Engineering, 2003, C23, 757-762.
Bercegeay, et al., "A One-Trip Gravel Packing System"; Society of Petroleum Engineers, Offshort Technology Conference, SPE Paper No. 4771; Feb. 7-8, 1974.
Bin et al., "Advances in Fluidization CVD Technology", East China University of Chemical Technology, China Academic Journal Electronic Publishing House, vol. 13, No. 4, Nov. 1992, pp. 360-365, English Abstract on p. 366.
Birbilis, et al., "Exploring Corrosion Protection of Mg Via Ionic Liquid Pretreatment", Surface & Coatings Technology; 201, pp. 4496-4504, (2007).
Bououdina, et al., "Comparative Study of Mechanical Alloying of (Mg+Al) and (Mg+Al+Ni) Mixtures for Hydrogen Storage", J. Alloys, Compds, 2002, 336, 222-231.
Bybee, "One-Trip Completion System Eliminates Perforations," Completions Today, Sep. 2007, pp. 52-53.
Canadian Office Action for Canadian Application No. 2,783,241, dated Feb. 25, 2013, pp. 1-3.
Canadian Office Action for Canadian Application No. 2,783,346, dated Feb. 21, 2013, pp. 1-4.
Canadian Office Action for Canadian Application No. 2,783,547, dated Feb. 15, 2013, pp. 1-3.
Canadian Office Action for Canadian Application No. 2,833,958, dated Sep. 23, 2014, pp. 1-2.
Canadian Office Action for Canadian Application No. 2,833,981, dated Sep. 23, 2014, pp. 1-2.
Canadian Office Action for Canadian Application No. 2,834,794, dated Dec. 15, 2014, pp. 1-3.
Canadian Office Action for Canadian Application No. 2,841,068, dated Jan. 23, 2015, pp. 1-3.
Canadian Office Action for Canadian Application No. 2,841,068, dated Nov. 9, 2015, pp. 1-4.
Canadian Office Action for Canadian Application No. 2,841,078, dated Oct. 7, 2014, pp. 1-2.
Canadian Office Action for Canadian Application No. 2,841,132, dated Mar. 11, 2015, pp. 1-4.
Canadian Office Action for Canadian Application No. 2,841,184, dated Apr. 16, 2015, pp. 1-5.
Canadian Office Action for Canadian Application No. 2,842,962, dated Mar. 19, 2015, pp. 1-6.
Canadian Office Action for Canadian Application No. 2,843,011, dated Mar. 31, 2015, pp. 1-4.
Canadian Office Action for Canadian Application No. 2,844,517, dated May 26, 2015, pp. 1-4.
Canadian Office Action for Canadian Application No. 2,845,339, dated May 1, 2015, pp. 1-3.
Canadian Office Action for Canadian Application No. 2,860,699, dated Jul. 16, 2015, pp. 1-4.
Carrejo, et al., "Improving Flow Assurance in Multi-Zone Fracturing Treatments in Hydrocarbon Reservoirs with High Strength Corrodible Tripping Balls"; Society of Petroleum Engineers; SPE Paper No. 151613; Apr. 16, 2012; 6 pages.
Chang, et al., "Electrodeposition of Aluminum on Magnesium Alloy in Aluminum Chloride (A1C13)-1-ethyl-3-methylimidazolium chloride (EMIC) Ionic Liquid and Its Corrosion Behavior"; Electrochemistry Communications; 9; pp. 1602-1606; (2007).
Chinese Office Action for Chinese Application No. 201080055613.5, dated Nov. 4, 2014, pp. 1-20.
Chinese Office Action for Chinese Application No. 201180012447.5, dated Jul. 3, 2014, 7 pages.
Chinese Office Action for Chinese Application No. 201180052095.6, dated Jul. 21, 2014, pp. 1-32.
Chinese Office Action for Chinese Application No. 201280036477.4, dated Nov. 4, 2015, pp. 1-15.
Chinese Office Action for Chinese Patent Application No. 201280041531.4 dated Aug. 31, 2015.
Chinese Office Action; Chinese Application No. 201180052095.6; dated Mar. 18, 2015; pp. 1-19.
Chinese Office Action; Chinese Application No. 201280020572.5; dated Oct. 10, 2015; 13 pages.
Chinese Office Action; Chinese Application No. 201280036253.3; dated Apr. 22, 2015; 21 pages.
Chinese Office Action; Chinese Application No. 201280036260.3; dated May 27, 2015; pp. 1-18.
Chinese Office Action; Chinese Application No. 201280041839.9; dated Feb. 10, 2015; pp. 1-37.
Christoglou, et al., "Deposition of Aluminum on Magnesium by a CVD Process", Surface and Coatings Technology 184 (2004) 149-155.
Chuan-Jun et al., "Study on Corrosion Kinetics of Mg—Ni alloys", Journal of Kunming University of Science and Technology, vol. 34, No. 5, pp. 10-13, Oct. 2009.
Constantine, "Selective Production of Horizontal Openhole Completions Using ECP and Sliding Sleeve Technology." SPE Rocky Mountain Regional Meeting, May 15-18, 1999, Gillette, Wyoming. [Abstract Only].
Coronado, "Development of an Internal Coiled Tubing Connector Utilizing Permanent Packer Technology"; Society of Petroleum Engineers, SPE Paper No. 46036; Apr. 15, 1998; 10 pages.
Curtin, et al., "CNT-reinforced ceramics and metals," Materials Today, 2004, vol. 7, pp. 44-49.
Danish Search Report and Opinion for Danish Application No. PA 2013 00060, dated Dec. 12, 2014, pp. 1-6.
International Search Report and Written Opinion; International Application No. PCT/US2012/038622; International Filing Date: May 18, 2012; dated Dec. 6, 2012; 12 pages.
International Search Report and Written Opinion; International Application No. PCT/US2012/034978; International Filing Date: Apr. 25, 2012; dated Nov. 12, 2012; 9 pages.
European Search Report for EP Application No. 10836533.9 dated Jul. 27, 2015; 7 pages.
European Search Report for EP Application No. 10836538.8 dated Jul. 27, 2015; 7 pages.
European Search Report for EP Application No. 10836539.6 dated Jul. 27, 2015; 7 pages.
European Search Report for EP Application No. 10836540.4 dated Aug. 20, 2015; 7 pages.
European Search Report for EP Application No. 12827733.2 dated Jan. 21, 2015; 6 pages.
European Search Report for EP Application No. 12827915.5 dated Dec. 23, 2015; 8 pages.
European Search Report for EP Application No. 12828903.0 dated Dec. 23, 2015.
European Search Report for European Application No. 12820355.1-1353, dated Dec. 18, 2015, 9 pages.
Extended European Search Report for EP Application No. 12828379.3-1373, dated May 20, 2016, 8 pages.

(56) References Cited

OTHER PUBLICATIONS

International Search Report and Written Opinion; International Application No. PCT/US2012/034973; International Filing Date: Apr. 25, 2012; dated Nov. 29, 2012; 8 pages.
Extended European Search Report; EP Application No. 12822169.4-1605/2739812; dated Nov. 17, 2015; 9 pages.
Feng, et al., "Electroless Plating of Carbon Nanotubes with Silver" Journal of Materials Science, 39, (2004) pp. 3241-3243.
Flahaut, et al., "Carbon Nanotube-Metal-Oxide Nanocomposites: Microstructure, Electrical Conductivity and Mechanical Properties" Acta amter. 48 (2000), pp. 3803-3812.
Forsyth, et al.; "An Ionic Liquid Surface Treatment for Corrosion Protection of Magnesium Alloy AZ31"; Electrochem. Solid-State Lett. 2006 vol. 9, Issue 11, B52-B55/ 9(11); Abstract only; 1 page.
Galanty, et al. "Consolidation of metal powders during the extrusion process," Journal of Materials Processing Technology (2002), pp. 491-496.
Garfield, "Formation Damage Control Utilizing Composite-Bridge-Plug Technology for Monobore, Multizone Stimulation Operations," SPE 70004, 2001, Society of Petroleum Engineers Inc., This paper was prepared for presentation at the SPE Per.
Garfield, New One-Trip Sand-Control Completion System that Eliminates Formation Damage Resulting From conventional Perforating and Gravel-Packing Operations:, SPE Annual Technical Conference and Exhibition, Oct. 9-12, 2005.
Garfield, et al., "Maximizing Inflow Performance in Soft Sand Completions Using New One-trip Sand Control Liner Completion Technology", SPE European Formation Damage Conference, May 25-27, 2005.
Goh, et al., "Development of novel carbon nanotube reinforced magnesium nanocomposites using the powder metallurgy technique", Nanottechnology 17 (2006) 7-12.
Gray, et al., "Protective Coatings on Magnesium and Its Alloys—a Critical Review", Journal of Alloys and Compounds 336 (2002), pp. 88-113.
Han, et al., "Mechanical Properties of Nanostructured Materials", Rev. Adv. Mater. Sci. 9(2005) 1-16.
Hermawan, et al., "Iron-manganese: new class of metallic degradable biomaterials prepared by powder metallurgy", Powder Metallurgy, vol. 51, No. 1, (2008), pp. 38-45.
Hjortstam, et al. "Can we achieve ultra-low resistivity in carbon nanotube-based metal composites," Applied Physics A (2004), vol. 78, Issue 8, pp. 1175-1179.
Hsiao, et al., "Anodization of AZ91D Magnesium Alloy in Silicate-Containing Electrolytes"; Surface & Coatings Technology; 199; pp. 127-134; (2005).
Hsiao, et al., "Baking Treatment Effect on Materials Characteristics and Electrochemical Behavior of anodic Film Formed on AZ91D Magnesium Alloy"; Corrosion Science; 49; pp. 781-793; (2007).
Hsiao, et al., "Characterization of Anodic Films Formed on AZ91D Magnesium Alloy"; Surface & Coatings Technology; 190; pp. 299-308; (2005).
Hsiao, et al., "Effect of Heat Treatment on Anodization and Electrochemical Behavior of AZ91D Magnesium Alloy"; J. Mater. Res.; 20(10); pp. 2763-2771;(2005).
Huo et al.; "Corrosion of AZ91D Magnesium Alloy with a Chemical Conversion Coating and Electroless Nickel Layer"; Corrosion Science: 46; pp. 1467-1477; (2004).
International Search Report and Written Opinion; International Application No. PCT/US2010/057763; International Filing Date: Nov. 23, 2010; dated Jul. 28, 2011; 10 pages.
International Search Report and Written Opinion; International Application No. PCT/US2010/059257; International Filing Date: Dec. 7, 2010; dated Jul. 27, 2011; 8 pages.
International Search Report and Written Opinion; International Application No. PCT/US2010/059259; International Filing Date: Dec. 7, 2010; dated Jun. 13, 2011; 8 pages.
International Search Report and Written Opinion; International Application No. PCT/US2010/059263; International Filing Date: Dec. 7, 2010; dated Jul. 8, 2011; 9 pages.
International Search Report and Written Opinion; International Application No. PCT/US2010/059265; International Filing Date: Dec. 7, 2010; dated Jun. 16, 2011; 8 pages.
International Search Report and Written Opinion; International Application No. PCT/US2010/059268; International Filing Date: Dec. 7, 2010; dated Jun. 17, 2011; 8 pages.
International Search Report and Written Opinion; International Application No. PCT/US2011/043036; International Filing Date: Jul. 6, 2011; dated Feb. 23, 2012; 9 pages.
International Search Report and Written Opinion; International Application No. PCT/US2011/047000; International Filing Date: Aug. 9, 2011; dated Dec. 26, 2011; 8 pages.
International Search Report and Written Opinion; International Application No. PCT/US2011/058099; International Filing Date: Oct. 27, 2011; dated May 11, 2012; 12 pages.
International Search Report and Written Opinion; International Application No. PCT/US2011/058105; International Filing Date: Oct. 27, 2011; dated May 1, 2012; 8 pages.
International Search Report and Written Opinion; International Application No. PCT/US2012/044866; International Filing Date: Jun. 29, 2012; dated Jan. 2, 2013; 9 pages.
International Search Report and Written Opinion; International Application No. PCT/US2012/046231; International Filing Date: Jul. 11, 2012; dated Jan. 29, 2013; 9 pages.
International Search Report and Written Opinion; International Application No. PCT/US2012/047163; International Filing Date: Jul. 18, 2012; dated Feb. 26, 2013; 12 pages.
International Search Report and Written Opinion; International Application No. PCT/US2012/049434; International Filing Date: Aug. 3, 2012; dated Feb. 1, 2013; 7 pages.
International Search Report and Written Opinion; International Application No. PCT/US2012/052836; International Filing Date: Aug. 29, 2012; dated Feb. 1, 2013; 9 pages.
International Search Report and Written Opinion; International Application No. PCT/US2012/053339; International Filing Date: Aug. 31, 2012; dated Feb. 15, 2013; 11 pages.
International Search Report and Written Opinion; International Application No. PCT/US2012/053342; International Filing Date: Aug. 31, 2012; dated Feb. 19, 2013; 9 pages.
International Search Report and Written Opinion; International Application No. PCT/US2012/053350; International Filing Date: Aug. 31, 2012; dated Feb. 25, 2013; 10 pages.
International Search Report and Written Opinion; International Application No. PCT/US2012/071742; International Filing Date: Dec. 27, 2012; dated Apr. 22, 2013; 12 pages.
International Search Report and Written Opinion; International Application No. PCT/US2013/020046; International Filing Date: Jan. 3, 2013; dated Apr. 10, 2013; 7 pages.
International Search Report and Written Opinion; International Application No. PCT/US2013/050475; International Filing Date: Jul. 15, 2013; dated Oct. 10, 2013; 12 pages.
International Search Report and Written Opinion; International Application No. PCT/US2014/010862; International Filing Date: Jan. 9, 2014; dated Apr. 21, 2014; 9 pages.
International Search Report and Written Opinion; International Application No. PCT/US2014/049347; International Filing Date: Aug. 1, 2014; dated Nov. 24, 2014; 11 pages.
International Search Report and Written Opinion; International Application No. PCT/US2014/054720; International Filing Date: Sep. 9, 2014; dated Dec. 17, 2014; 10 pages.
International Search Report and Written Opinion; International Application No. PCT/US2014/058997, International Filing Date: Oct. 3, 2014; dated Jan. 12, 2015; 12 pages.
International Search Report and Written Opinion; International Application No. PCT/US2015/066353; International Filing Date: Dec. 17, 2015; dated Apr. 1, 2016; 14 pages.
International Search Report for related PCT Application No. PCT/US2013/035258, dated Jul. 4, 2013, pp. 1-4.
International Search Report for related PCT Application No. PCT/US2013/035261, dated Jul. 10, 2013, pp. 1-4.
International Search Report for related PCT Application No. PCT/US2013/035262, dated Jul. 1, 2013, pp. 1-4.

(56) References Cited

OTHER PUBLICATIONS

International Search Report for related PCT Application No. PCT/US2013/068062, dated Feb. 12, 2014, pp. 1-3.
International Search Report; International Application No. PCT/US2012/044229, International Filing Date: Jun. 26, 2012; dated Jan. 30, 2013; 3 pages.
Kuzumaki, et al.; "Mechanical Characteristics and Preparation of Carbon Nanotube Fiber-Reinforced Ti Composite", Advanced Engineering Materials, 2000, 2, No. 7.
Lavernia, et al.,"Cryomilled Nanostructured Materials: Processing and Properties", Materials Science and Engineering A, 493, (2008) pp. 207-214.
Lee, et al., "Effects of Ni addition on hydrogen storage properties of Mg17AL12 alloy", Materials Chemistry and Physics, 2011, 126, pp. 319-324.
Li, "Design of Abrasive Water Jet Perforation and Hydraulic Fracturing Tool," Oil Field Equipment, Mar. 2011.
Li, et al., "Investigation of aluminium-based nancompsoites with ultra-high strength", Materials Science and Engineering A, 527, pp. 305-316, (2009).
Lin et al., "Processing and Microstructure of Nano-Mo/Al2O3 Composites from MOCVD and Fluidized Bed", Nanostructured Materials, Nov. 1999, vol. 11, No. 8, pp. 1361-1377.
Liu, et al., "Calculated Phase Diagrams and the Corrosion of Die-Cast Mg—Al Alloys", Corrosion Science, 2009, 51, 606-619.
Liu, et al.; "Electroless Nickel Plating on AZ91 Mg Alloy Substrate"; Surface & Coatings Technology; 200; pp. 5087-5093; (2006).
Lunder et al.; "The Role of Mg17Al12 Phase in the Corrosion of Mg Alloy AZ91"; Corrosion; 45(9); pp. 741-748; (1989).
M.S. Senthil Saravanan et al, "Mechanically Alloyed Carbon Nanotubes (CNT) Reinforced Nanocrystalline AA 4032: Synthesis and Characterization", Journal of Minerals and Materials Characterization and Engineering, vol. 9, No. 11 pp. 1027-1035 2010.
Maisano, "Cryomilling of Aluminum-Based and Magnesium-Based Metal Powders", Thesis, Virginia Tech, Jan. 13, 2006.
Majumdar, et al., "Laser Surface Engineering of a Magnesium Alloy with Al + Al2O3", Surface and Coatings Technology 179 (2004) pp. 297-305.
Malaysian Search Report for Application No. PI 2012002545 dated May 31, 2016, 3 pages.
Mathis, "Sand Management: A Review of Approaches and Concerns", Society of Petroleum Engineers, SPE Paper No. 82240, SPE European Formation Damage Conference, The Hague, The Netherlands, May 13-14, 2003.
Murray, "Binary Alloy Phase Diagrams" Int. Met. Rev., 30(5) 1985 vol. 1, pp. 103-187.
Nie, "Patents of Methods to Prepare Intermetallic Matrix Composites: A Review", Recent Patents on Materials Science 2008, vol. 1, pp. 232-240.
Chinese Office Action for Chinese Application No. 201380006291.9 dated Apr. 27, 2016, 25 pages.
Canadian Office Action for Application No. 2860699; dated Oct. 7, 2015, 4 pages.
Chinese Office Action for Chinese Application No. 201280041320.0; dated Jun. 6, 2016, 14 pages.
Saravanan et al., "Mechanically Alloyed Carbon Nanotubes (CNT) Reinforced Nanocrystalline AA 4032: Synthesis and Characterization," Journal of Minerals & Materials Characterization & Engineering, vol. 9, No. 11, pp. 1027-1035, 2010.
Rose, et al.; "The application of the polyaromatic sulfonates as tracers in geothermal reservoirs", Geothermics 30 (2001) pp. 617-640.
Office Action dated Feb. 1, 2016 in related Canadian Patent Application No. 2,844,517, 4 pages.
Office Action dated Mar. 23, 2016 in related EP Patent Application No. 12827733.2, 6 pages.
Australian Office Action for Patent Application No. 2012302067; dated Feb. 2, 2015, 3 pages.
Pardo, et al.; "Corrosion Behaviour of Magnesium/Aluminium Alloys in 3.5 wt% NaC1"; Corrosion Science; 50; pp. 823-834; (2008).
Australian Examination Report for Australian patent application No. 2012302067 dated Sep. 22, 2015; 3 pages.
Quik Drill Composite Frac Plug; Baker Hughes, Baker Oil Tools; Copyright 2002; 3 pages.
Zhang, et al.; "Study on the Environmentally Friendly Anodizing of AZ91D Magnesium Alloy"; Surface and Coatings Technology: 161; pp. 36-43; (2002).
Zhu, et al., "The process of coating on ultrafine particles by surface hydrolysis reaction in a fluidized bed reactor", Surface and Coatings Technology 135 (2000) 14-17.
Seyni, et al., "On the interest of using degradable fillers in co-ground composite materials", Powder Technology 190, (2009) pp. 176-184.
Shaw, "Benefits and Application of a Surface-Controlled Sliding Sleeve for Fracturing Operations"; Society of Petroleum Engineers, SPE Paper No. 147546; Oct. 30, 2011; 8 pages.
Shi, et al.; "Influence of the Beta Phase on the Corrosion Performance of Anodised Coatings on Magnesium-Aluminium Alloys"; Corrosion Science; 47; pp. 2760-2777; (2005).
Shigematsu, et al., "Surface Treatment of AZ91D Magnesium Alloy by Aluminum diffusion Coating", Journal of Materials Science Letters 19, 2000, pp. 473-475.
Shimizu, et al., "Multi-walled carbon nanotube-reinforced magnesium alloy composites", Scripta Materialia, vol. 58, Issue 4, Feb. 2008, pp. 267-270.
Shumbera, et al. "Improved Water Injector Performance in a Gulf of Mexico Deepwater Development Using an Openhole Frac Pack Completion and Downhole Filter System: Case History." SPE Annual Technical Conference and Exhibition, Oct. 5-8, 2003.
Singh, et al., "Extended Homogeneity Range of Intermetallic Phases in Mechanically Alloyed Mg—Al Alloys", Elsevier Sciences Ltd., Intemetallics 11, 2003, pp. 373-376.
Song, "Recent Progress in Corrosion and Protection of Magnesium Alloys"; Advanced Engineering Materials; 7(7); pp. 563-586; (2005).
Song, et al.; "A Possible Biodegradable Magnesium Implant Material," Advanced Engineering Materials, vol. 9, Issue 4, Apr. 2007, pp. 298-302.
Song, et al.; "Corrosion Behaviour of AZ21, AZ501 and AZ91 in Sodium Chloride"; Corrosion Science; 40(10); pp. 1769-1791; (1998).
Song, et al.; "Corrosion Mechanisms of Magnesium Alloys"; Advanced Engineering Materials; 1(1); pp. 11-33; (1999).
Song, et al.; "Influence of Microstructure on the Corrosion of Diecast AZ91D"; Corrosion Science; 41; pp. 249-273; (1999).
Song, et al.; "Understanding Magnesium Corrosion"; Advanced Engineering Materials; 5; No. 12; pp. 837-858; (2003).
Spencer et al., "Fluidized Bed Polymer Particle ALD Process for Producing HDPE/Alumina Nanocomposites", The 12th International Conference on Fluidization—New Horizons in Fluidization Engineering, vol. RP4 (2007).
Stanley, et al.; "An Introduction to Ground-Water Tracers", Department of Hydrology and Water Resources, University of Arizona, Mar. 1985, pp. 1-219.
Sun, et al.; "Colloidal Processing of Carbon Nanotube/Alumina Composites" Chem. Mater. 2002, 14, pp. 5169-5172.
Triolo et al., "Resolving the Completion Engineer's Dilemma: Permanent or Retrievable Packer?"; Society of Petroleum Engineers, SPE Paper No, 76711; May 20, 2002; 16 pages.
Tsipas et al. "Effect of High Energy Ball Milling on Titanium-Hydroxyapatite Powders" Powder Metallurgy, Maney Publishing, London, GB, vol. 46, No. 1, Mar. 2003 (Mar. 2003), pp. 73-77.
Vahlas, et al., "Principles and Applications of CVD Powder Technology", Materials Science and Engineering R 53 (2006) pp. 1-72.
Vernon Constien et al., "Development of Reactive Coatings to Protect Sand-Control Screens", SPE 112494, Copyright 2008, Society of Petroleum Engineers, Presented at the 2008 SPE International Symposium and Exhibition on Formation Damage Control.

(56) References Cited

OTHER PUBLICATIONS

Vickery, et al.; "New One-Trip Multi-Zone Frac Pack System with Positive Positioning." European Petroleum Conference, Oct. 29-31, 2002, Aberdeen, UK. [Abstract Only].
Walters, et al.; "A Study of Jets from Unsintered-Powder Metal Lined Nonprecision Small-Caliber Shaped Charges", Army Research Laboratory, Aberdeen Proving Ground, MD 21005-5066; Feb. 2001.
Wang, et al., "Contact-Damage-Resistant Ceramic/Single-Wall Carbon Nanotubes and Ceramic/Graphite Composites" Nature Materials, vol. 3, Aug. 2004, pp. 539-544.
Watanabe, et al., "Superplastic Deformation Mechanism in Powder Metallurgy Magnesium Alloys and Composites", Acta mater. 49 (2001) pp. 2027-2037.
Watarai, Trend of research and development for magnesium alloys—reducing the weight of structural materials in motor vehicles, (2006) Science and technology trends, Quaterly review No. 18, 84-97.
Welch, et al., "Nonelastomeric Sliding Sleeve Maintains Long Term Integrity in HP/HT Application: Case Histories" [Abstract Only], SPE Eastern Regional Meeting, Oct. 23-25, 1996, Columbus. Ohio.
Xu, et al., "Nanostructured Material-Based Completion Tools Enhance Well Productivity"; International Petroleum Technology Conference; Conference Paper IPTC 16538; International Petroleum Technology Conference 2013; 4 pages.
Zemel, "Tracers in the Oil Field", University of Texas at Austin, Center for Petroleumand Geosystems, Jan. 1995, Chapters 1, 2, 3, 7.
Zeng, et al. "Progress and Challenge for Magnesium Alloys as Biomaterials," Advanced Engineering Materials, vol. 10, Issue 8, Aug. 2008, pp. B3-B14.
Zhan, et al., "Single-wall carbon nanotubes as attractive toughening agents in alumina-based nanocomposites" Nature Materials, vol. 2., Jan. 2003, pp. 38-42.
Zhang, et al.; "Formation of metal nanowires on suspended single-walled carbon nanotubes" Applied Physics Letter, vol. 77, No. 19 (2000), pp. 3015-3017.
Zhang, et al.; "High Strength Nanostructured Materials and Their Oil Field Applications"; Society of Petroleum Engineers; Conference Paper SPE 157092; SPE International Oilfield Nanotechnology Conference, 2012; 6 pages.
Zhang, et al.; "Metal Coating on Suspended Carbon Nanotubes and its Implication to Metal-Tube Interaction", Chemical Physics Letters 331 (2000) 35-41.
"Declaration of Karl T. Hartwig in Support of Petitioner Pursuant to 37 C.F.R. § 42.120", executed on Nov. 21, 2016 in support of U.S. Pat. No. 8,573,295, 52 pages.
"Declaration of Karl T. Hartwig in Support of Petitioner Pursuant to 37 C.F.R. § 42.120", executed on Nov. 21, 2016 in support of U.S. Pat. No. 9,101,978, 51 pages.
AP African Office Action for African Application No. AP/P/2014/007389, dated Oct. 6, 2016, 5 pages.
Australian Examination Report, Australian Application No. 2012271765, dated Feb. 28, 2017, Australian Intellectual Property Office; Australian Examination Report 2 pages.
Aviles et al, "Degradable Alternative to Risky Mill-Out Operations in Plug and Perf"; SPE-173695-MS; Society of Petroleum Engineers; SPE/ICOTA Coiled Tubing & Well Intervention Conference & Exhibition; Mar. 24-25, 2015; 10 Pages.
Callister, Jr., William D., Materials Science and Engineering An Introduction, Seventh Edition, 2006, pp. 111, 627, and G7.
EP Search Report, PCT/US2012049434; Application No. EP 12823958; dated Jun. 15, 2016; 9 pages.
Extended European Search Report for EP Application No. 10836539.6-1353, dated Jul. 27, 2015, 7 pages.
German, Randall M., Powder Metallurgy Science, Second Edition, 1994, 102 pages.
International Search Report and Written Opinion, International Application No. PCT/US2016/041849, dated Oct. 26, 2016, Korean Intellectual Property Office; International Search Report 5 pages, Written Opinion 7 pages.
Klar, Erhard, ASM Handbook: International Metals Handbook—Powder Metallurgy, vol. 7, 1997, pp. 14, 276, and 798.
Notification of Transmittal of the International Search Report and the Written Opinion of the International Searching Authority, or the Declaration; PCT/US2016/015948; dated May 3, 2016: 10 pages.
Petition for Inter Partes Review; Case No. IPR2017-00326; U.S. Pat. No. 9,101,978; Nov. 23, 2016; 46 pages.
Petition for Inter Partes Review; Case No. IPR2017-00327; U.S. Pat. No. 8,573,295; Nov. 23, 2016; 53 pages.
Reid, Gary Carl, "Literature evaluation of induced groundwater tracers, field tracer techniques, and hydrodynamic dispersion values in porous media", Theisis in Geosciences (Masters), Texas Tech University, Aug. 1981, 109 pages.
Russian Office Action Issued for Patent Application No. 2014149137, Translation 6 pages; Office Action 7 pages.
Russian Search Report, Russian Application No. 2014149137, dated Feb. 8, 2017; 4 pages.
Schaffer, James P. et al., The Science and Design of Engineering Materials, Second Edition, 1999, pp. 122, 123, 698, and 699.
Wang, et al. "Laser claddling of eutectic-based Ti—Ni—Al alloy coating on magnesium surface", Surface & Coatings Technology 205 (2010); pp. 189-194.
Xie, Guoqiang et al., "TEM Observation of Interfaces between Particles in Al—Mg Alloy Powder Compacts Prepared by Pulse Electric Current Sintering", Materials Transactions, 2002, pp. 2177-2180, vol. 43—No. 9.
Yue, et al. "Laser cladding of Ni/Cu/Al functionally graded coating on magnesium substrate", Surface & Coatings Technology 202 (2008); pp. 3043-3049.
Yue, et al. Microstructure and Phase Evolution in Laser Cladding of Ni/Cu/Al Multilayer on Magnesium Substrates; Metallurgical and Materials Transactions A, vol. 41A, Jan. 2010; pp. 212-223.

* cited by examiner

SEAT FOR A TUBULAR TREATING SYSTEM

CROSS REFERENCE TO RELATED APPLICATION

This application is a divisional application of U.S. patent application Ser. No. 13/358,317, filed Jan. 25, 2012, the entire contents of which are incorporated herein by reference.

BACKGROUND

Tubular systems, such as those used in the completion and carbon dioxide sequestration industries often employ anchors to positionally fix one tubular to another tubular. Although existing anchoring systems serve the function for which they are intended, the industry is always receptive to new systems and methods for anchoring tubulars.

BRIEF DESCRIPTION

Disclosed herein is a seat for a tubular treating system. The seat includes a single piece body having a central portion, and a frustoconical surface extending longitudinally from the central portion in a first direction configured to radially expand slips urged thereagainst. The seat also includes a collar extending longitudinally from the central portion in a second direction configured to be radially expanded into sealing engagement with a structure in response to a frustoconical member urged thereagainst. A seal surface is sealably engagable with a plug run thereagainst, and the seal surface is longitudinally displaced from the collar in the first direction.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
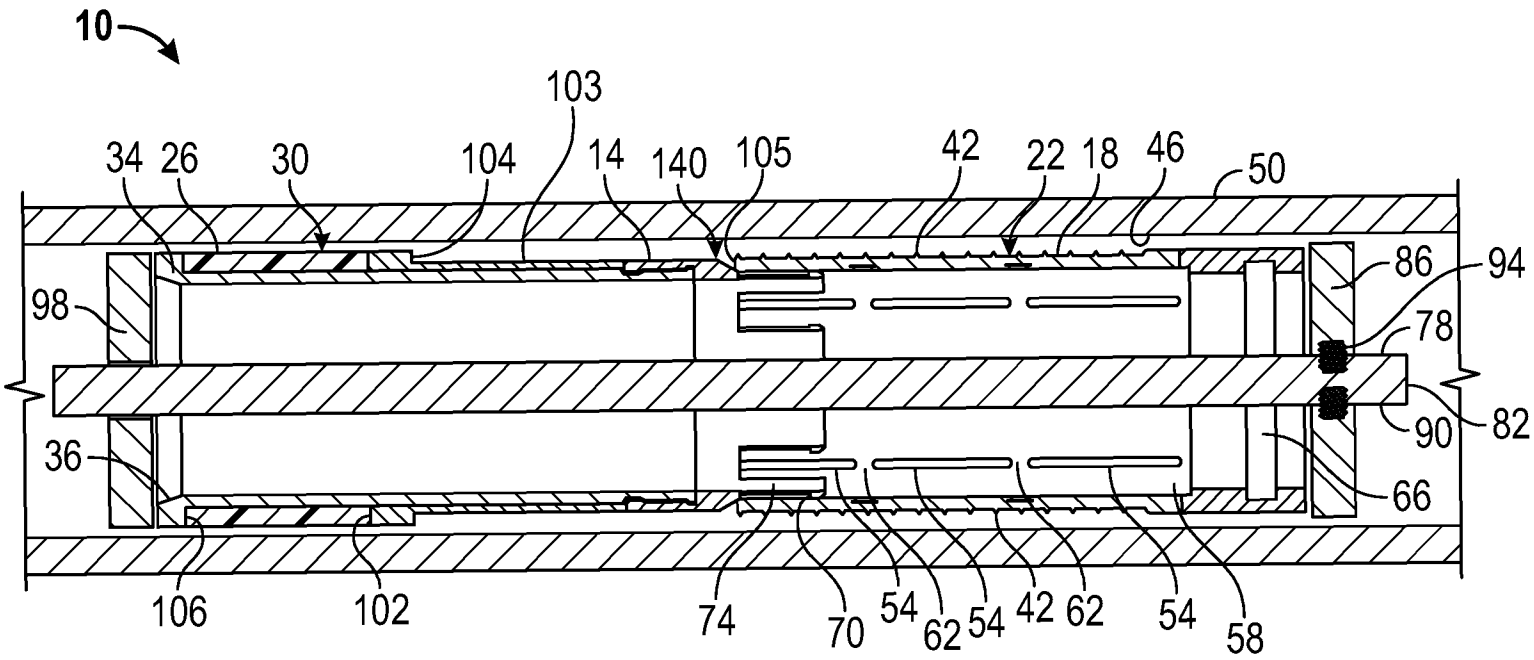
FIG. 1 depicts a cross sectional view of a tubular anchoring system disclosed herein in a non-anchoring position.
Figure 2:
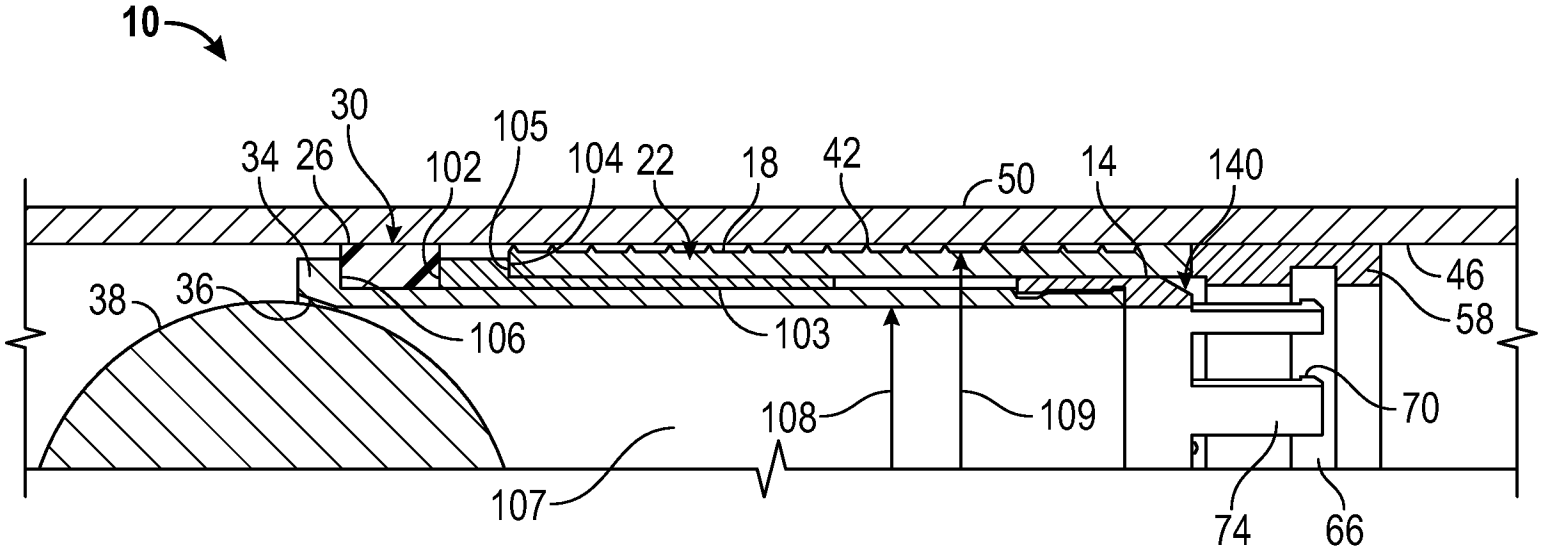
FIG. 2 depicts a cross sectional view of the tubular anchoring system of FIG. 1 in an anchoring position.

Referring to FIGS. 1 and 2, a tubular anchoring system disclosed herein is illustrated at 10. The system 10, among other things includes, a frustoconical member 14, a sleeve 18, shown herein as a slip ring having a surface 22, a seal 26, having a surface 30, and a seat 34. The system is configured such that longitudinal movement of the frustoconical member 14 relative to the sleeve 18 and relative to the seal 26 cause the surfaces 22 and 30 of the sleeve 18 and seal 26 respectively to be radially altered. And, although in this embodiment the radial alterations are in radially outward directions, in alternate embodiments the radial alterations could be in other directions such as radially inward. The seat 34 is connected with the frustoconical member 14 such that movement of the seat 34 also causes movement of the frustoconical member 14. And the seat 34 has a land 36 that is sealingly engagable with a plug 38, shown herein as a ball (in FIG. 2 only), runnable thereagainst. Once the plug 38 is sealingly engaged with the seat 34 pressure can be built upstream thereof to perform work such as fracturing an earth formation or actuating a downhole tool, for example, when employed in a hydrocarbon recovery application.

The surface 22 of the sleeve 18 in this embodiment includes protrusions 42 that may be referred to as teeth, configured to bitingly engage with a wall 46 of a structure 50, within which the system 10 is employable, when the surface 22 is in a radially altered (i.e. expanded) configuration. This biting engagement serves to anchor the system 10 to the structure 50 to prevent relative movement therebetween. Although the structure 50 disclosed in this embodiment is a tubular, such as a liner or casing in a borehole, it could just as well be an open hole in an earth formation, for example.

In the embodiment illustrated in the FIGS. 1 and 2 the sleeve 18 includes a plurality of slots 54 that extend fully through walls 58 thereof that are distributed perimetrically about the sleeve 18 as well as longitudinally along the sleeve 18. The slots 54, in this embodiment, are configured such that a longitudinal dimension of each is greater than a dimension perpendicular to the longitudinal dimension. Webs 62 in the walls 58 extend between pairs of longitudinally adjacent slots 54. The foregoing structure permits the sleeve 18 to be radially altered by the frustoconical member 14 with less force than if the slots 54 did not exist. The webs 62 may be configured to rupture during radial alteration of the sleeve 18 to further facilitate radial alteration thereof.

The sleeve 18 also has a recess 66 formed in the walls 58 that are receptive to shoulders 70 on fingers 74 that are attached to the seat 34. Once the seat 34 has moved sufficiently relative to the sleeve 18 that the shoulders 70 are engaged in the recess 66 the seat 34 is prevented from moving in a reverse direction relative to the sleeve 18, thereby maintaining the frustoconical member 14 longitudinally overlapping with the sleeve 18. This overlapping assures that the radial expansion of the sleeve 18 is maintained even after forces that drove the frustoconical member 14 into the sleeve 14 are withdrawn. Additional embodiments are contemplated for maintaining relative position between the frustoconical member 14 and the sleeve 18 once they have become longitudinally overlapped including frictional engagement between the frustoconical member 14 and the sleeve 18, as well as wickers on one or both of the frustoconical member 14 and the sleeve 18 that engage with a surface of the other, for example.

A setting tool 78 (FIG. 1 only) can generate the loads needed to cause movement of the frustoconical member 14 relative to the sleeve 18. The setting tool 78 can have a mandrel 82 with a stop 86 attached to one end 90 by a force failing member 94 shown herein as a plurality of shear screws. A plate 98 guidingly movable along the mandrel 82 (by means not shown herein) in a direction toward the stop 86 can longitudinally urge the frustoconical member 14 toward the sleeve 18. Loads to fail the force failing member 94 can be set to only occur after the sleeve 18 has been radially altered by the frustoconical member 14 a selected amount. After failure of the force failing member 94 the stop 86 may separate from the mandrel 82 thereby allowing the mandrel 82 and the plate 98 to be retrieved to surface, for example.

Movement of the frustoconical member 14 relative to the sleeve 18 causes the seal 26 to be longitudinally compressed, in this embodiment, between a shoulder 102, on a collar 103 movable with the frustoconical member 14, and a shoulder 106, on the seat 34. This compression is caused by another shoulder 104 on the collar 103 coming in contact with an end 105 of the frustoconical member 14. This longitudinal compression results in growth in a radial thickness of the seal 26. The frustoconical member 14 being positioned radially inwardly of the seal 26 prevents the seal 26 from reducing in dimension radially. Consequently, the surface 30 of the seal 26 must increase radially. An amount of this increase can be set to cause the surface 30 to contact the walls 46 of the structure 50 (FIG. 2 only) resulting in sealing engagement therewith between. As with the anchoring of the sleeve 18 with the walls 46, the seal 26 is maintained in sealing engagement with the walls 46 by the shoulders 70 of the fingers 74 being engaged with the recess 66 in the sleeve 18.

The tubular anchoring system 10 is configured such that the sleeve 18 is anchored (positionally fixed) to the structure 50 prior to the seal 26 sealingly engaging with the structure 50. This is controlled by the fact that the seal 26 is not longitudinally compressed between the end 105 of the sleeve 18 and the shoulder 102 until a significant portion of the sleeve 18 has been radially expanded over the frustoconical member 14 and into anchoring engagement with the structure 50. Positionally anchoring the tubular anchoring system 10 to the structure 50 prior to engaging the seal 26 with the structure has the advantage of preventing relative movement between the seal 26 and the structure 50 after the seal 26 has radially expanded. This sequence prevents damage to the seal 26 that could result if the seal 26 were allowed to move relative to the structure 50 after having been radially expanded. The land 36 of the seat 34 in this embodiment is positioned longitudinally upstream (as defined by fluid flow that urges the plug 38 against the seat 34) of the sleeve 18. Additionally in this embodiment the land 36 is positioned longitudinally upstream of the seal 26. This relative positioning allows forces generated by pressure against the plug 38 seated against the land 36 to further compress the seal 28 into sealing engagement with the structure 50.

The tubular anchoring system 10 is further configured to leave a through bore 107 with a minimum radial dimension 108 that is large in relation to a radial dimension 109 defined by a largest radial dimension of the system 10 when set within the structure 50. In fact the minimum radial dimension 108 is no less than about 70% of the radial dimension 109. Such a large ratio allows the anchoring system 10 to be deployed as a treatment plug, or a frac plug, for example, in a downhole application. In such an application pressure built against the plug 38 seated at the land 36 can be used to frac a formation that the structure is positioned within. Subsequent the fracing operation production through the through bore 107 could commence, after removal of the plug 38 via dissolution or pumping, for example, without the need of drilling or milling any of the components that define the tubular anchoring system 10.

Figure 3:
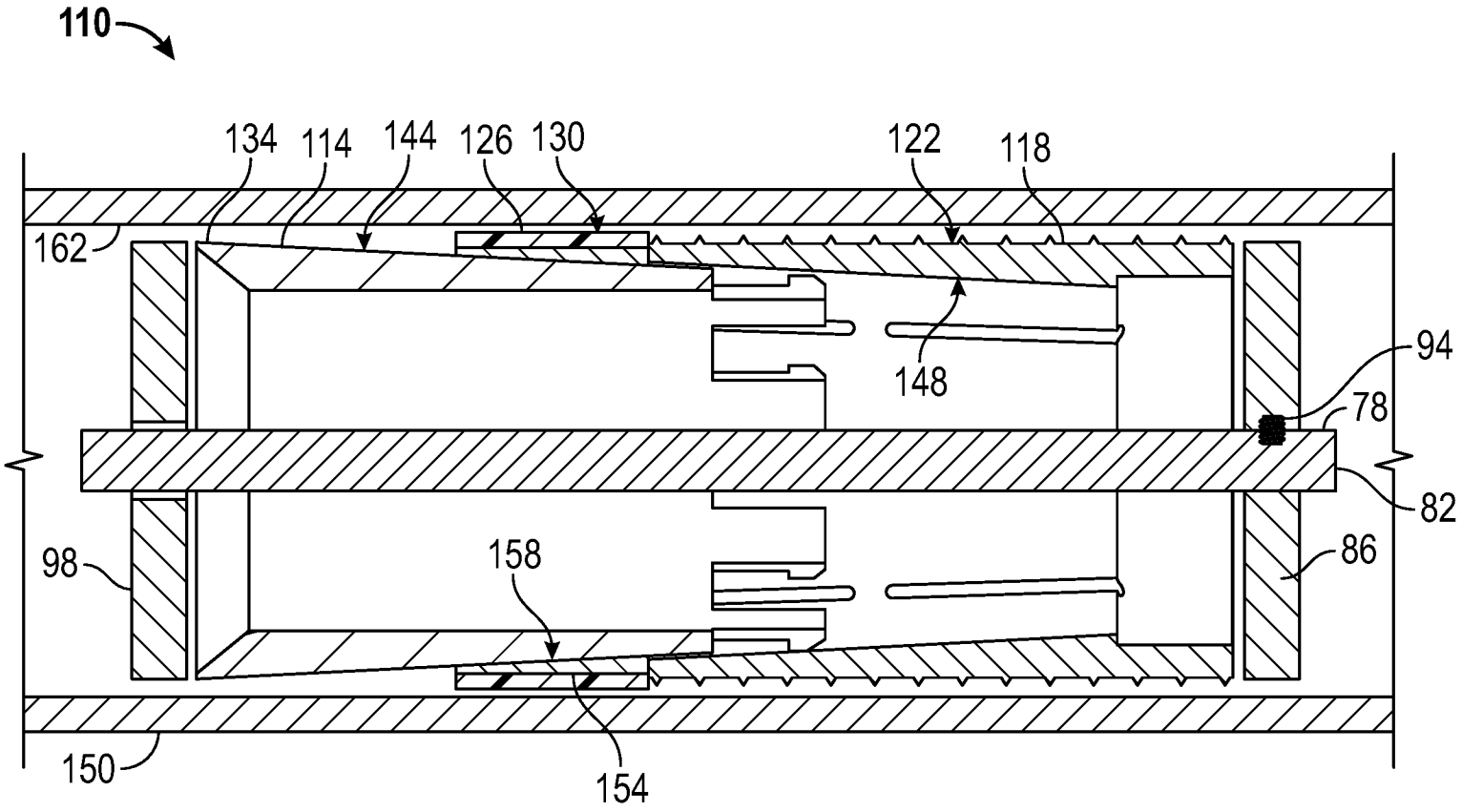
FIG. 3 depicts a cross sectional view of an alternate tubular anchoring system disclosed herein in a non-anchoring position.
Figure 4:
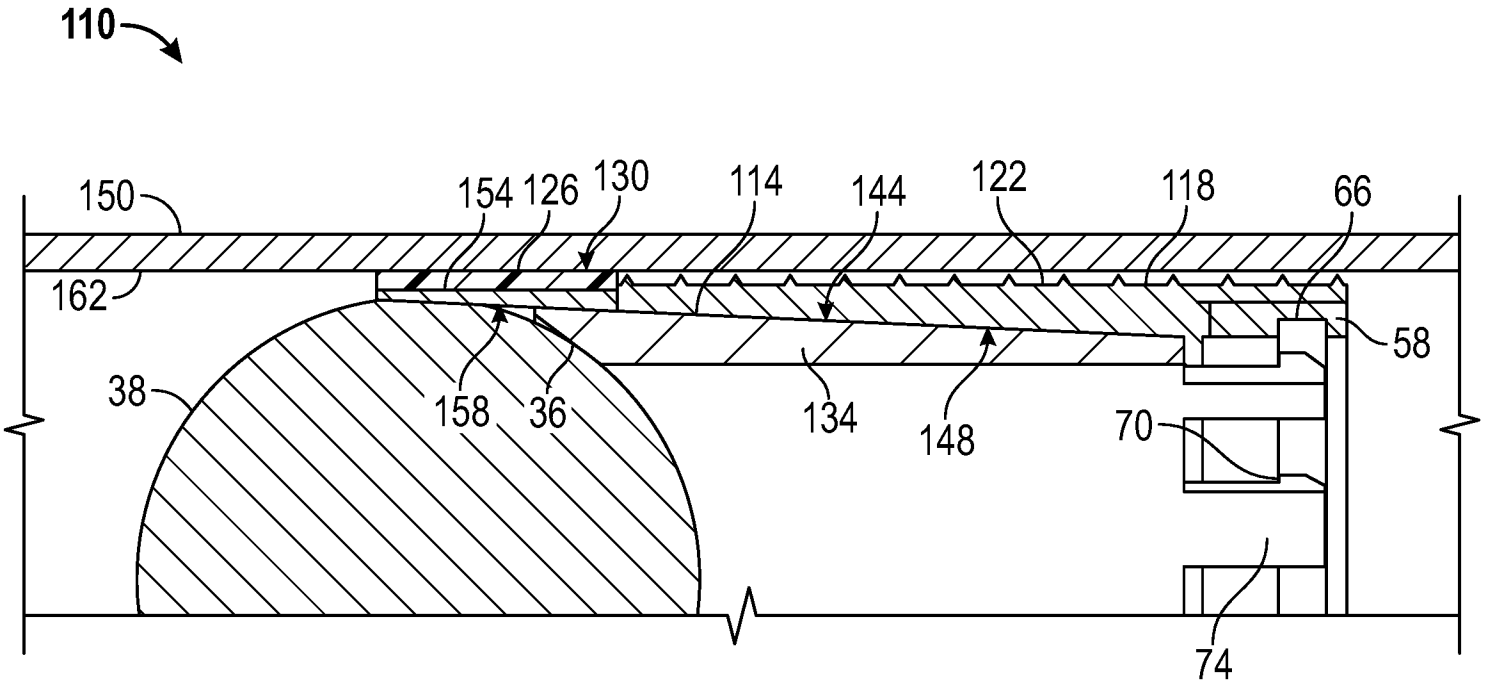
FIG. 4 depicts a cross sectional view of the tubular anchoring system of FIG. 3 in an anchoring position.

Referring to FIGS. 3 and 4, an alternate embodiment of a tubular anchoring system disclosed herein is illustrated at 110. Similar to the system 10 the system 110 includes a frustoconical member 114, a sleeve 118 having a surface 122, a seal 126 having a surface 130 and a seat 134. A primary difference between the system 10 and the system 110 is how the extents of radial alteration of the surfaces 22 and 30 are controlled. In the system 10 an extent of radial alteration of the surface 22 is determined by a radial dimension of a frustoconical surface 140 on the frustoconical member 14. And the extent of radial alteration of the surface 30 is determined by an amount of longitudinal compression that the seal 26 undergoes.

In contrast, an amount of radial alteration that the surface 122 of the sleeve 118 undergoes is controlled by how far the frustoconical member 114 is forced into the sleeve 118. A frustoconical surface 144 on the frustoconical member 114 is wedgably engagable with a frustoconical surface 148 on the sleeve 118. As such, the further the frustoconical member 114 is moved relative to the sleeve 118 the greater the radial alteration of the sleeve 118. Similarly, the seal 126 is positioned radially of the frustoconical surface 144 and is longitudinally fixed relative to the sleeve 118 so the further the frustoconical member 114 moves relative to the sleeve 118 and the seal 126 the greater the radial alteration of the seal 126 and the surface 130. The foregoing structure allows an operator to determine the amount of radial alteration of the surfaces 122, 130 after the system 110 is positioned within a structure 150.

Optionally, the system 110 can include a collar 154 positioned radially between the seal 126 and the frustoconical member 114, such that radial dimensions of the collar 154 are also altered by the frustoconical member 114 in response to the movement relative thereto. The collar 154 can have a frustoconical surface 158 complementary to the frustoconical surface 144 such that substantially the full longitudinal extent of the collar 154 is simultaneously radially altered upon movement of the frustoconical member 114. The collar 154 may be made of a material that undergoes plastic deformation to maintain the seal 126 at an altered radial dimension even if the frustoconical surface 144 is later moved out of engagement with the frustoconical surface 158, thereby maintaining the seal 126 in sealing engagement with a wall 162 of the structure 150.

Other aspects of the system 110 are similar to those of the system 10 including, the land 36 on the seat 126 sealably engagable with the plug 38. And the slots 54 and the webs 62 in the walls 58 of the sleeve 118. As well as the recess 66 in the sleeve 118 receptive to shoulders 70 on the fingers 74. Additionally, the system 110 is settable with the setting tool 78 in a similar manner as the system 10 is settable with the setting tool 78.

Figure 5:
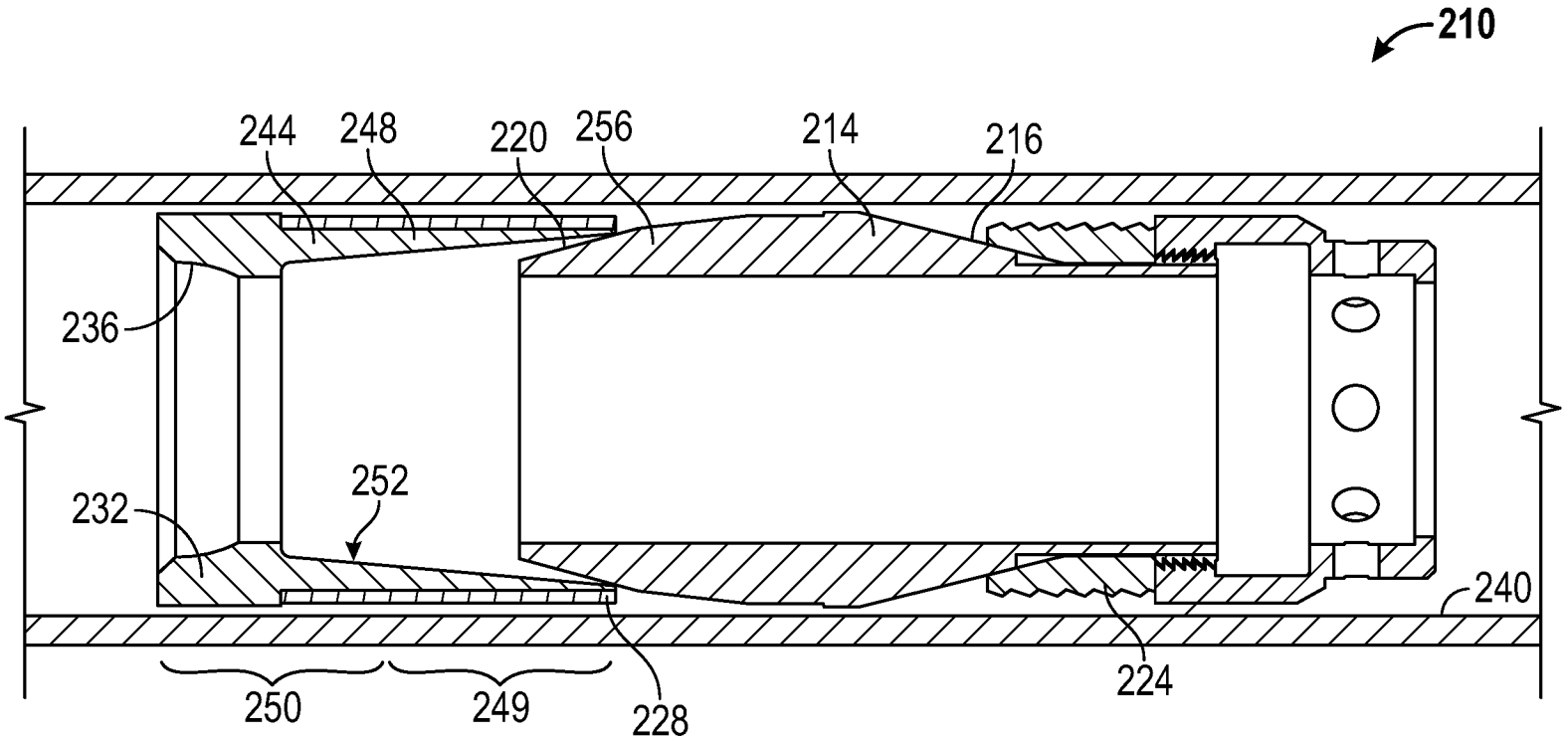
FIG. 5 depicts a cross sectional view of an alternate tubular anchoring system disclose herein.

Referring to FIG. 5 an alternate embodiment of a tubular anchoring system disclosed herein is illustrated at 210. The system 210 includes, a frustoconical member 214 having a first frustoconical portion 216 and a second frustoconical portion 220 that are tapered in opposing longitudinal directions to one another. Slips 224 are radially expandable in response to being moved longitudinally against the first frustoconical portion 216. Similarly, a seal 228 is radially expandable in response to being moved longitudinally against the second frustoconical portion 220. One way of moving the slips 224 and the seal 228 relative to the frustoconical portions 216, 220 is to longitudinally compress the complete assembly with a setting tool that is not shown herein, that could be similar to the setting tool 78. The system 210 also includes a seat 232 with a surface 236 that is tapered in this embodiment and is receptive to a plug (not shown) that can sealingly engage the surface 236.

The tubular anchoring system 210 is configured to seal to a structure 240 such as a liner, casing or open hole in an earth formation borehole, for example, as is employable in hydrocarbon recovery and carbon dioxide sequestration applications. The sealing and anchoring to the structure 240 allows pressure built against a plug seated thereat to build for treatment of the earth formation as is done during fracturing and acid treating, for example. Additionally, the seat 232 is positioned in the system 210 such that pressure applied against a plug seated on the seat 232 urges the seat 232 toward the slips 224 to thereby increase both sealing engagement of the seal 228 with the structure 240 and anchoring engagement of the slips 224 with the structure 240.

The tubular anchoring system 210 can be configured such that the slips 224 are anchored (positionally fixed) to the structure 240 prior to the seal 228 sealingly engaging with the structure 240, or such that the seal 228 is sealingly engaged with the structure 240 prior to the slips 224 anchoring to the structure 240. Controlling which of the seal 228 and the slips 224 engage with the structure first can be through material properties relationships or dimensional relationships between the components involved in the setting of the seal 228 in comparison to the components involved in the setting of the slips 224. Regardless of whether the slips 224 or the seal 228 engages the structure 240 first may be set in response to directions of portions of a setting tool that set the tubular anchoring system 210. Damage to the seal 228 can be minimized by reducing or eliminating relative movement between the seal 228 and the structure 50 after the seal 228 is engaged with the structure 240. In this embodiment, having the seal 228 engage with the structure 240 prior to having the slips 224 engage the structure 240 may achieve this goal. Conversely, in the embodiment of the tubular anchoring system 10, discussed above, having the sleeve 18 engage with the structure 50 before the seal 26 engages with the structure may achieve this goal.

The land 236 of the seat 232 in this embodiment is positioned longitudinally upstream (as defined by fluid flow that urges a plug against the seat 232) of the slips 224. Additionally in this embodiment the land 236 is positioned longitudinally upstream of the seal 228. This relative positioning allows forces generated by pressure against a plug seated against the land 236 to further urge the seal 228 into sealing engagement with the structure 240.

The seat 232 of the embodiment illustrated in the system 210 also includes a collar 244 that is positioned between the seal 228 and the second frustoconical portion 220. The collar 244 illustrated has a wall 248 whose thickness is tapered due to a radially inwardly facing frustoconical surface 252 thereon. The varied thickness of the wall 248 allows for thinner portions to deform more easily than thicker portions. This can be beneficial for at least two reasons. First, the thinner walled portion 249 needs to deform when the collar 244 is moved relative to the second frustoconical portion 220 in order for the seal 228 to be radially expanded into sealing engagement with the structure 240. And second, the thicker walled portion 250 needs to resist deformation due to pressure differential thereacross that is created when pressuring up against a plug seated at the seat 232 during treatment operations, for example. The taper angle of the frustoconical surface 252 may be selected to match a taper angle of the second frustoconical portion 220 to thereby allow the second frustoconical portion 220 to provide radial support to the collar 244 at least in the areas where they are in contact with one another.

Regardless of whether the taper angles match, the portion of the collar 244 that deforms conforms to the second frustoconical portion 220 sufficiently to be radially supported thereby. The taper angles may be in the range of 14 to 20 degrees to facilitate radial expansion of the collar 244 and to allow frictional forces between the collar 244 and the second frustoconical portion 220 to maintain positional relationships therebetween after removal of longitudinal forces that caused the movement therebetween. (The first frustoconical portion 216 may also have taper angles in the range of 14 to 20 degrees for the same reasons that the second frustoconical portion 220 does). Either or both of the frustoconical surface 252 and the second frustoconical portion 220 may include more than one taper angle as is illustrated herein on the second frustoconical portion 220 where a nose 256 has a larger taper angle than the surface 220 has further from the nose 256. Having multiple taper angles can provide operators with greater control over amounts of radial expansion of the collar 244 (and subsequently the seal 228) per unit of longitudinal movement between the collar 244 and the frustoconical member 214. The taper angles, in addition to other variables, also provide additional control over longitudinal forces needed to move the collar 244 relative to the frustoconical member 214. Such control can allow the system 210 to preferentially expand the collar 244 and the seal 228 to set the seal 228 prior to expanding and setting the slips 224. Such a sequence may be desirable since setting the slips 224 before the seal 228 would require the seal 228 to move along the structure 240 after engaging therewith, a condition that could damage the seal 228.

Figure 6:
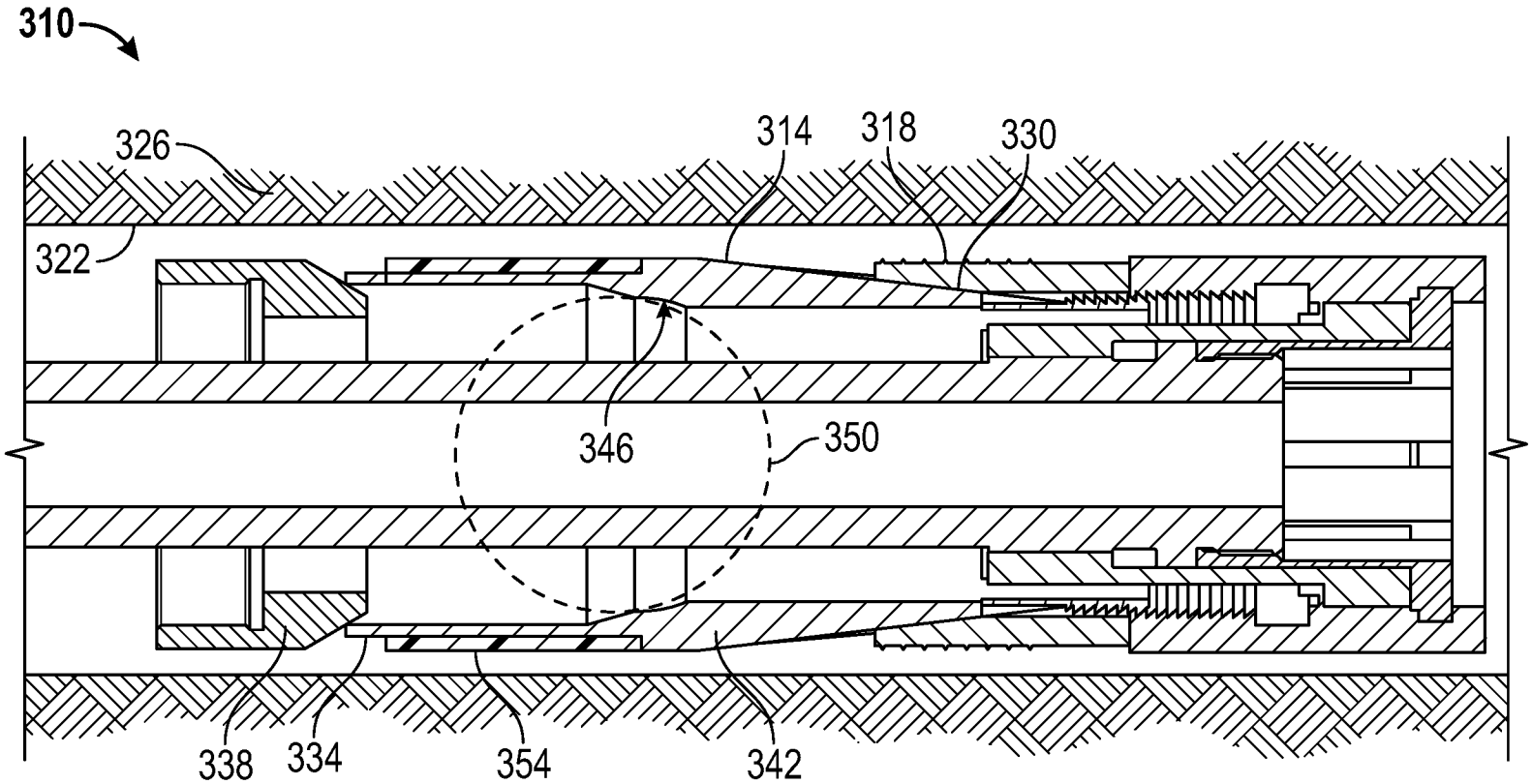
FIG. 6 depicts a cross sectional view of yet another alternate tubular anchoring system disclosed herein.

Referring to FIG. 6, another alternate embodiment of a tubular anchoring system disclosed herein is illustrated at 310. The system 310 includes a first frustoconical member 314, slips 318 positioned and configured to be radially expanded into anchoring engagement with a structure 322, illustrated herein as a wellbore in an earth formation 326, in response to being urged against a frustoconical surface 330 of the first frustoconical member 314. A collar 334 is radially expandable into sealing engagement with the structure 322 in response to being urged longitudinally relative to a second frustoconical member 338. And a seat 342 with a surface 346 sealingly receptive to a plug 350 (shown with dashed lines) runnable thereagainst. The seat 342 is displaced in a downstream direction (rightward in FIG. 6) from the collar 334 as defined by fluid that urges the plug 350 against the seat 342. This configuration and position of the surface 346 relative to the collar 334 aids in maintaining the collar 334 in a radially expanded configuration (after having been expanded), by minimizing radial forces on the collar 334 due to pressure differential across the seat 342 when plugged by a plug 350.

To clarify, if the surface 346 were positioned in a direction upstream of even a portion of the longitudinal extend of the collar 334 (which it is not) then pressure built across the plug 350 seated against the surface 346 would generate a pressure differential radially across the portion of the collar 334 positioned in a direction downstream of the surface 346. This pressure differential would be defined by a greater pressure radially outwardly of the collar 334 than radially inwardly of the collar 334, thereby creating radially inwardly forces on the collar 334. These radially inwardly forces, if large enough, could cause the collar 334 to deform radially inwardly potentially compromising the sealing integrity between the collar 334 and the structure 322 in the process. This condition is specifically avoided by the positioning of the surface 346 relative to the collar 334 of the instant invention.

Optionally, the tubular anchoring system 310 includes a seal 354 positioned radially of the collar 334 configured to facilitate sealing of the collar 334 to the structure 322 by being compressed radially therebetween when the collar 334 is radially expanded. The seal 354 maybe fabricated of a polymer to enhance sealing of the seal 354 to both the collar 334 and the structure 322.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A seat for a tubular treating system comprising:

a single piece body having:

a central portion;

a frustoconical surface extending longitudinally from the central portion in a first direction configured to radially expand slips urged thereagainst;

a collar extending longitudinally from the central portion in a second direction configured to be radially expanded into sealing engagement with a structure in response to a frustoconical member urged thereagainst; and a seal surface sealably engagable with a plug run thereagainst, the seal surface being longitudinally displaced from the collar in the first direction.

2. The seat for a tubular treating system of claim 1, wherein the single piece body is metal.

3. The seat for a tubular treating system of claim 1, wherein the collar is receptive to a seal positioned radially of the collar.

4. The seat for a tubular treating system of claim 3, wherein the seal positioned radially of the collar is a polymer.

5. The seat for a tubular treating system of claim 1, wherein pressure on a radially inward portion of the collar is greater than pressure downstream of a plug seated at the seal surface due to a pressure differential built across the seated plug.

6. A tubular anchoring system comprising:

a first frustoconical member;

slips in operable communication with the first frustoconical member being radially expandable into anchoring engagement with a structure in response to longitudinal movement relative to a frustoconical surface of the first frustoconical member;

a collar in operable communication with the first frustoconical member being radially expandable into sealing engagement with the structure in response to longitudinal movement relative to a second frustoconical member; and a seat in operable communication with the first frustoconical member having a surface configured to be sealingly engagable with a plug runnable thereagainst, the surface being longitudinally positioned relative to the collar so that force generated by the plug longitudinally across the seat when plugged while the collar is sealed to the structure does not generate radial forces on the collar.

* * * * *